US008190069B2

(12) United States Patent
Saiki et al.

(10) Patent No.: US 8,190,069 B2
(45) Date of Patent: May 29, 2012

(54) VISIBLE IMAGE FORMING DEVICE AND IMAGE FORMING APPARATUS

(75) Inventors: Atsuna Saiki, Saitama (JP); Kazuhiro Saito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 236 days.

(21) Appl. No.: 12/640,055

(22) Filed: Dec. 17, 2009

(65) Prior Publication Data

US 2010/0266310 A1 Oct. 21, 2010

(30) Foreign Application Priority Data

Apr. 16, 2009 (JP) ..... 2009-100200

(51) Int. Cl.
*G03G 15/08* (2006.01)

(52) U.S. Cl. ..... 399/262; 399/102

(58) Field of Classification Search ..... 399/119, 399/262, 258, 102, 103, 106
See application file for complete search history.

(56) References Cited

U.S. PATENT DOCUMENTS

| | | | | |
|---|---|---|---|---|
| 4,949,399 | A * | 8/1990 | Williams et al. | 399/119 |
| 5,305,064 | A * | 4/1994 | Trott et al. | 399/258 |
| 5,839,027 | A * | 11/1998 | Sahay et al. | 399/106 |
| 7,162,189 | B2 * | 1/2007 | Tsuda et al. | 399/258 |
| 7,634,217 | B2 * | 12/2009 | Tamura et al. | 399/258 |
| 7,848,684 | B2 * | 12/2010 | Kawai | 399/258 |
| 2002/0028081 | A1 | 3/2002 | Ito et al. | |
| 2008/0199224 | A1 * | 8/2008 | Isomura et al. | 399/258 |

FOREIGN PATENT DOCUMENTS

| | | | |
|---|---|---|---|
| JP | 2002-072657 | A | 3/2002 |
| JP | 2006-091284 | A | 4/2006 |
| JP | 2008-020605 | A | 1/2008 |

* cited by examiner

*Primary Examiner* — Susan Lee
(74) *Attorney, Agent, or Firm* — Sughrue Mion, PLLC

(57) ABSTRACT

An image forming apparatus includes an image carrier, a developing device, a developer container and a hole connection member. The developing device is provided so as to be movable in a direction in which it comes close to and goes away from the image carrier. And, the developing device develops a latent image formed on the surface of the image carrier into a visible image. The hole connection member is supported so as to be movable relative to an inlet of the developing device in the movable direction of the developing device and connects the inlet and an outlet of the developer container.

4 Claims, 17 Drawing Sheets

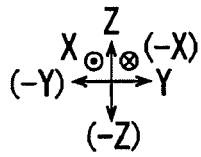
FIG. 13A
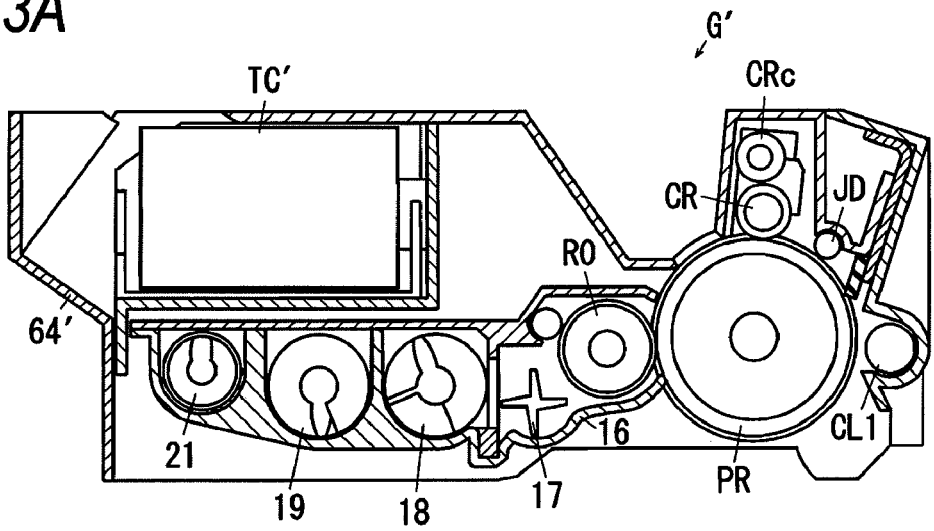
FIG. 13B
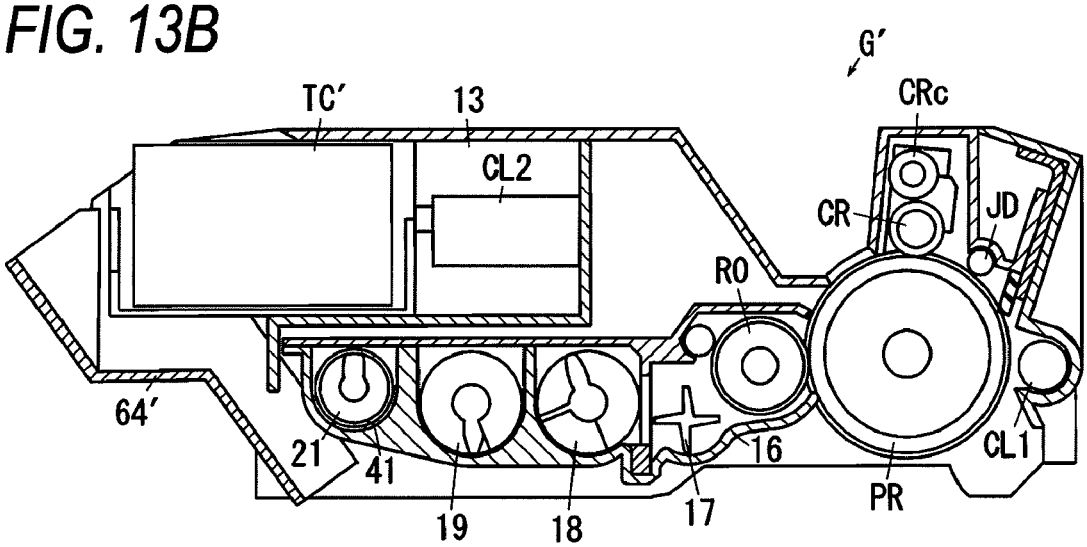

VISIBLE IMAGE FORMING DEVICE AND IMAGE FORMING APPARATUS

CROSS-REFERENCE TO RELATED APPLICATIONS

This application is based on and claims priority under 35 USC 119 from Japanese Patent Application No. 2009-100200 filed on Apr. 16, 2009.

BACKGROUND

1. Technical Field

The present invention relates to a visible image forming device and an image forming apparatus

SUMMARY

According to an aspect of the invention, an image forming apparatus includes an image carrier, a developing device, an urging member, a contact subject portion, a contact portion, a developer container. The developing device is provided to be movable in a direction in which the developing device comes close to and goes away from the image carrier, and serves to develop a latent image formed on a surface of the image carrier into a visible image. The developing device includes: a developing device container that transports developer inside the developing device container; a developer carrier that is opposed to the image carrier, and holds developer supplied from the developing device container on a surface of the developer carrier; and an inlet through which developer flows into the developing device container. The urging member urges the developing device in such a direction that the developing device comes closer to the image carrier. The contact subject portion is integral with the image carrier. The contact portion is provided in the developing device, and contacts the contact subject portion. An interval is kept between the image carrier and the developer carrier at a preset value. And the developer container is detachably mounted, with the outlet opposed to the inlet, in a mounting unit which is integral with a support frame which supports the image carrier. The developer container includes: a container main body that contains developer to be supplied to the developing device container; and an outlet through which developer flows out from inside the container main body. The inlet is connected to the outlet so as to be movable relative to the outlet in the movable direction of the developing device.

BRIEF DESCRIPTION OF THE DRAWINGS

Exemplary embodiment(s) of the present invention will be described in detail based on the following figures, wherein:

FIG. 5A is a perspective view in which a front frame is viewed obliquely from the front side and FIG. 5B is a perspective view in which the front frame is viewed obliquely from the rear side;

FIG. 6A is a perspective view in which a rear frame is viewed obliquely from the front side and FIG. 6B is a perspective view in which the rear frame is viewed obliquely from the rear side;

FIG. 8A is a partially sectional perspective view of a part of the process cartridge in a state that an inlet shutter is removed and FIG. 8B is a sectional view of the process cartridge in a state the toner cartridge is mounted;

FIGS. 13A and 13B illustrate a toner image forming device according to a second exemplary embodiment in a state that a toner cartridge is moved to a mounting position and in a state the toner cartridge is moved to a detaching position, respectively;

DETAILED DESCRIPTION

Figure 1:
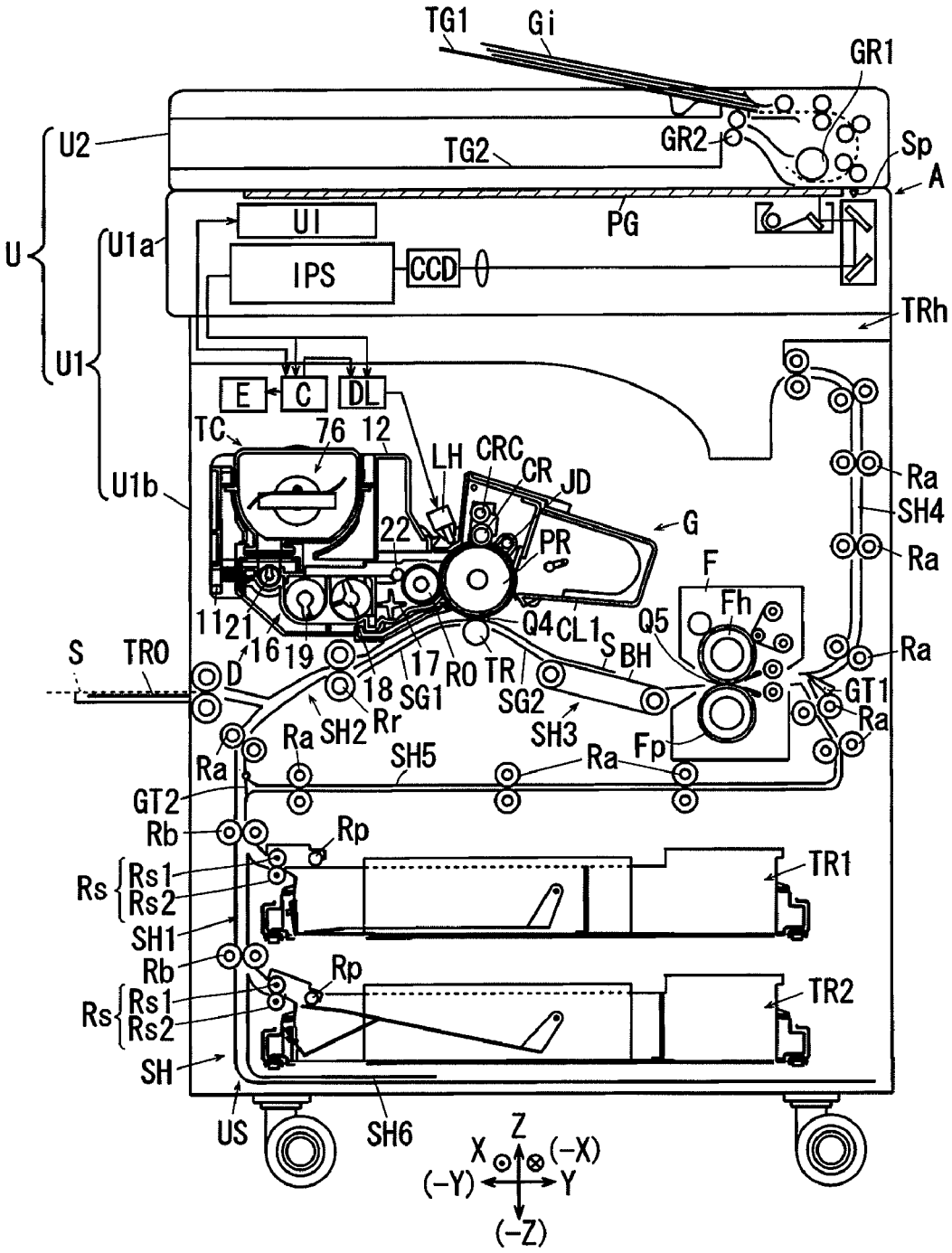
FIG. 1 is a sectional view illustrating the whole of an image forming apparatus according to a first exemplary embodiment of the present invention.

Specific exemplary embodiments of the present invention will be hereinafter described with reference to the drawings. However, the invention is not limited to the following exemplary embodiments.

To facilitate understanding of the following description, in the drawings, the X-axis direction, the Y-axis direction, and the Z-axis direction are defined as the front-rear direction, the right-left direction, and the top-bottom direction, respectively and the directions or sides indicated by arrows X, -X, Y, -Y, and Z, and -Z are defined as the front direction or side, the rear direction or side, the right direction or side, the left direction or side, the top direction or side, and the bottom direction or side, respectively.

In the drawings, a circle "o" having a dot "." inside means an arrow that is directed from the back side to the front side of the paper surface and a circle "o" having a cross "x" inside means an arrow that is directed from the front side to the back side of the paper surface.

Furthermore, in the drawings, to facilitate understanding, members etc. that are not indispensable for a description may be omitted as appropriate.

Exemplary Embodiment 1

FIG. 1 is a sectional view illustrating the whole of an image forming apparatus according to a first exemplary embodiment of the invention.

As shown in FIG. 1, a copier U (example image forming apparatus) according to the first exemplary embodiment of the invention is equipped with a digital copier main body U1 (example image forming apparatus main body) having a transparent document stage (platen glass) PG as a top surface and an automatic document feeder U2 which is mounted on the platen glass PG in a detachable manner.

The automatic document feeder U2 is equipped with a document container TG1 in which a stack of plural document sheets Gi to be copied is housed. The plural document sheets Gi housed in the document container TG1 are caused to sequentially pass through a copying position on the platen glass PG, that is, the position of a platen roll GR1 (example document feeding member), and then to be ejected to an ejected document tray TG2.

The copier main body U1 is equipped with a scanner unit U1*a* (example image reading device) having the platen glass PG and a printer unit U1*b* (example image recording device).

The scanner unit U1*a* is equipped with an exposure system position detecting member (exposure system registration sensor) Sp disposed at a reading reference position and an exposure optical system A.

The exposure optical system A, whose movement and stop are controlled by a detection signal of the exposure system registration sensor Sp, is kept stopped at the reading reference position ordinarily.

In the case of an automatic document feed copying operation using the automatic document feeder U2, the exposure optical system A which is stopped at the reading reference position exposes document sheets Gi that sequentially pass through the copying position on the platen glass PG.

In the case of a manual document feed copying operation in which an operator places a document sheet Gi on the platen glass PG manually, the exposure optical system A scans and exposes the document sheet Gi on the platen glass PG while moving parallel with the platen glass PG.

Reflection light coming from each document sheet Gi being exposed passes through the exposure optical system A and is focused on a solid-state imaging device CCD. The solid-state imaging device CCD converts the reflection light that is focused on its imaging surface into an electrical signal.

An image processing unit IPS converts the image signal received from the solid-state imaging device CCD into a digital image writing signal and outputs it to a writing drive signal output device DL of the printer unit U1*b*.

The writing drive signal output device DL, whose operation timing is controlled by a control unit C of the printer unit U1*b*, outputs a writing drive signal corresponding to the received image data to a latent image writing device LH. The latent image writing device LH of the first exemplary embodiment is a device (LED head) in which LEDs (example latent image writing elements) are arranged linearly in the front-rear direction.

Figure 2:
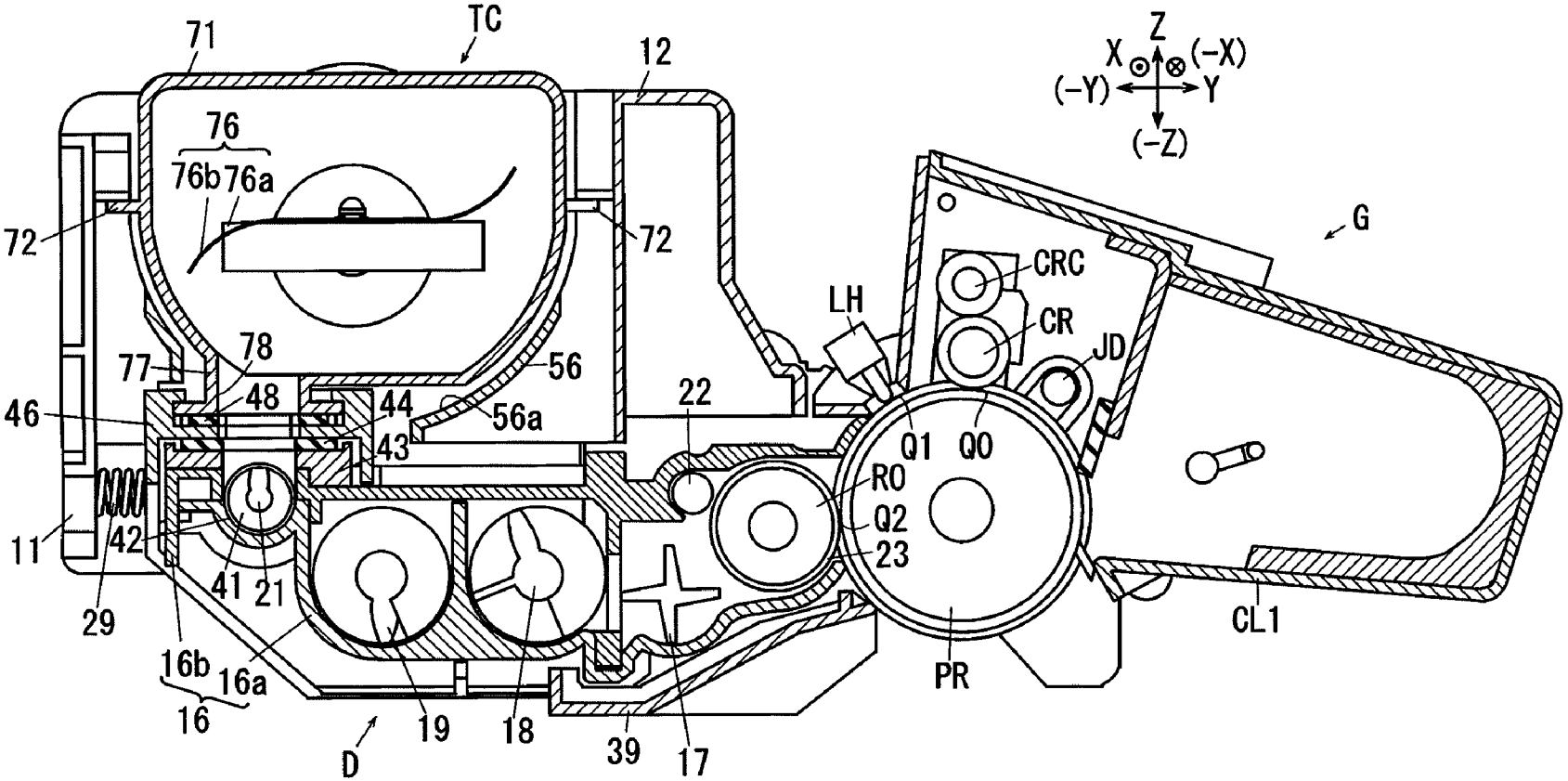
FIG. 2 illustrates a part of a toner image forming device according to the first exemplary embodiment.

FIG. 2 illustrates a part of a toner image forming device according to the first exemplary embodiment.

As shown in FIGS. 1 and 2, a photoreceptor body PR (example rotary image carrier) is disposed near the center of the copier main body U1. A surface portion of the photoreceptor body PR is charged by a charging roll CR (example charger) in a charging region Q0 and then exposed by the latent image writing device LH at a latent image writing position Q1, whereby an electrostatic latent image is formed thereon. The surface portion of the photoreceptor body PR on which the electrostatic latent image has been formed is rotated and thereby passes a development region Q2 and a transfer region Q4 sequentially.

A developing device D transports developer with a developing roll R0 (example developer carrier) to the development region Q2 and develops the electrostatic latent image on the surface portion of the photoreceptor body PR that is passing the development region Q2 into a toner image (example visible image).

As developer is consumed in the developing device D, new developer is supplied from a toner cartridge TC (example developer container) which is supported in a detachable manner so as to be located above the developing device D.

A transfer roll TR (example transfer device) which is opposed to the photoreceptor body PR in the transfer region Q4 is a member for transferring the toner image formed on the surface of the photoreceptor body PR to a sheet S (example medium) The transfer roll TR is supplied, from a power circuit E, with a transfer voltage whose polarity is opposite to the charging polarity of the development toner used in the developing device D. Application voltage such as the charging voltage to be applied to the charging roll CR, a developing voltage to be applied to the developing roll R0, and the transfer voltage to be applied to the transfer roll TR, heater power for heating a heater of a heating roll of a fusing device F (described later), etc. are supplied from the power circuit E, which is controlled by the control unit C.

A first sheet supply tray TR1 and a second sheet supply tray TR2 (example sheet supply units) are disposed so as to occupy a bottom space of the copier main body Ul and to be arranged vertically.

A pickup roll Rp (example sheet pickup member) is disposed close to the top of a left end portion of each of the first sheet supply tray TR1 and the second sheet supply tray TR2. Sheets S that have been picked up by the pickup roll Rp are conveyed to a separating member Rs.

The separating member Rs has a feed roll Rs1 (example sheet feed member) and a retard roll Rs2 (example sheet separating member) which are pressed against each other. Sheets that have been conveyed to the separating member Rs are separated into individual sheets and conveyed one by one to a sheet conveyance path SH1 (example medium conveyance path) by the separating member Rs.

Conveying rolls Rb (example conveying members) capable of rotating in the normal and reverse directions are disposed adjacent to the sheet conveyance path SH1. The sheet S that has been conveyed to the sheet conveyance path SH1 is conveyed to a pre-transfer sheet conveyance path SH2 located above by the conveying rolls Tb.

The sheet S that has been conveyed to the pre-transfer sheet conveyance path SH2 is conveyed to registration rolls Rr (example timing adjusting members) by conveying rolls Ra.

A sheet S that has been supplied from a manual feed tray TR0 (example manual sheet supply unit) is likewise conveyed to the registration rolls Rr.

The sheet S that has been conveyed to the registration rolls Rr is conveyed to the transfer region Q4 from a pre-transfer sheet guide SG1 (example pre-transfer guide member) so as to be timed with movement of a toner image on the photoreceptor body PR to the transfer region Q4.

The toner image that has been developed on the surface of the photoreceptor body PR is transferred to the sheet S in the transfer region Q4 by the transfer roll TR. After the transfer, the surface of the photoreceptor body PR is cleaned by a cleaner CL1, whereby residual toner (example stuck substance) is removed.

The charge is removed, by a charge remover JD, from the surface of the photoreceptor body PR from which the residual toner has been removed, and then the surface of the photoreceptor body PR is charged again by the charging roll CR. The charging roll CR is cleaned (i.e., dirt is removed) by a charging roll cleaner CRC (example cleaner for the charging purpose) which is disposed so as to be opposed to and be in contact with the charging roll CR.

The photoreceptor body PR, the charging roll CR, the latent image writing device LH, the developing device D, the cleaner CL1, etc. constitute a toner image forming device G (example visible image forming device). In the first exemplary embodiment, the toner image forming device G is implemented as a single unit (process cartridge) which can be replaced, that is, attached to and removed from the copier main body U1.

The sheet S to which the toner image has been transferred in the transfer region Q4 is peeled off the surface of the photoreceptor body PR, guided by a sheet guide SG2 (example post-transfer guide member) of a post-transfer conveyance path SH3, and conveyed to the fusing device F by a sheet conveying belt BH (example post-transfer conveying member).

The fusing device F is equipped with a heating roll Fh (example heat fusing member) having a heater (heat source) inside and a pressing roll Fp (example pressure fusing member). The toner image is heat-fused to the sheet S that has been conveyed to the fusing device F when it passes through the fusing region where the heating roll Fh and the pressing roll Fp are in contact with each other. The sheet S thus processed is conveyed to an ejected sheet tray TRh (example ejected medium tray) past a sheet ejection path SH4.

A switching gate GT1 (example conveyance path switching member) is disposed in the sheet ejection path SH4 immediately downstream of the fusing device F. The switching gate GT1 switches the conveyance destination of the sheet S that has passed through the fusing device F between the ejected sheet tray TRh and a flip connection path SH5. The flip connection path SH5 connects the upstream end of the sheet ejection path SH4, that is, its end immediately downstream of the fusing device F, to the sheet conveyance path SH1.

In the case of double-sided printing, a one-side-recorded sheet S on whose first surface a toner image is recorded is conveyed to the flip connection path SH5 by the switching gate GT1, passes through a Mylar gate GT2 (example direction restricting member), and is conveyed to a flip path SH6 by the conveying rolls Rb which rotate reversely. The sheet S that has been conveyed to the flip path SH6 is conveyed upward (i.e., it serves as a switchback) by the conveying rolls Rb which rotates in the normal direction, and conveyed again to the transfer region Q4 in a flipped state.

The paths SH1-SH6 constitute a sheet conveyance path SH (example medium conveyance path).

The sheet conveyance path SH and the rolls Ra, Rb, Rr, etc. which are disposed adjacent to it and have a sheet conveying function constitute a sheet conveying device US (example medium conveying device).

(Process Cartridge)

Figure 3A:
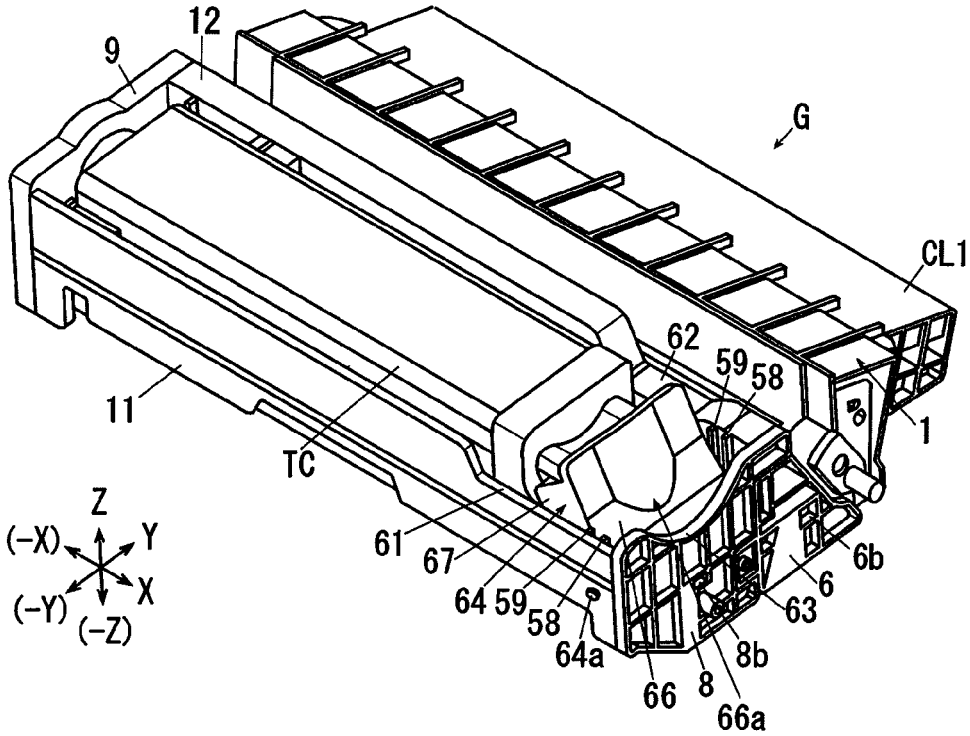
FIGS. 3A and 3B are perspective views of a process cartridge according to the first exemplary embodiment in a state that a toner cartridge is moved to a mounting position and in a state that the toner cartridge is moved to a detaching position, respectively.
Figure 3B:
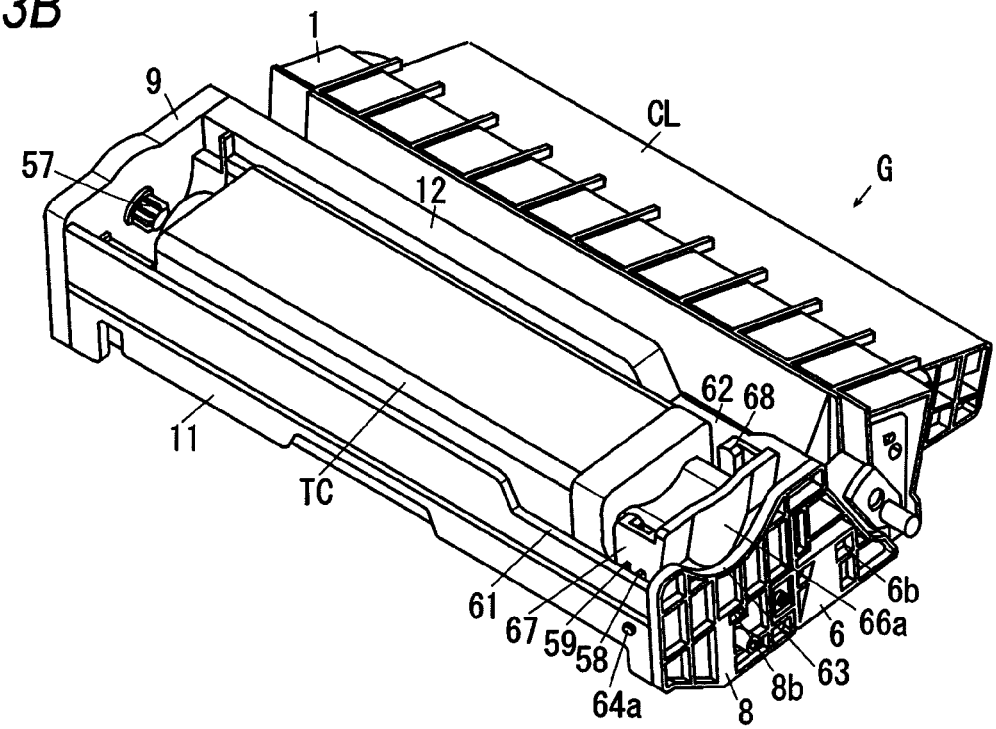
Figure 4:
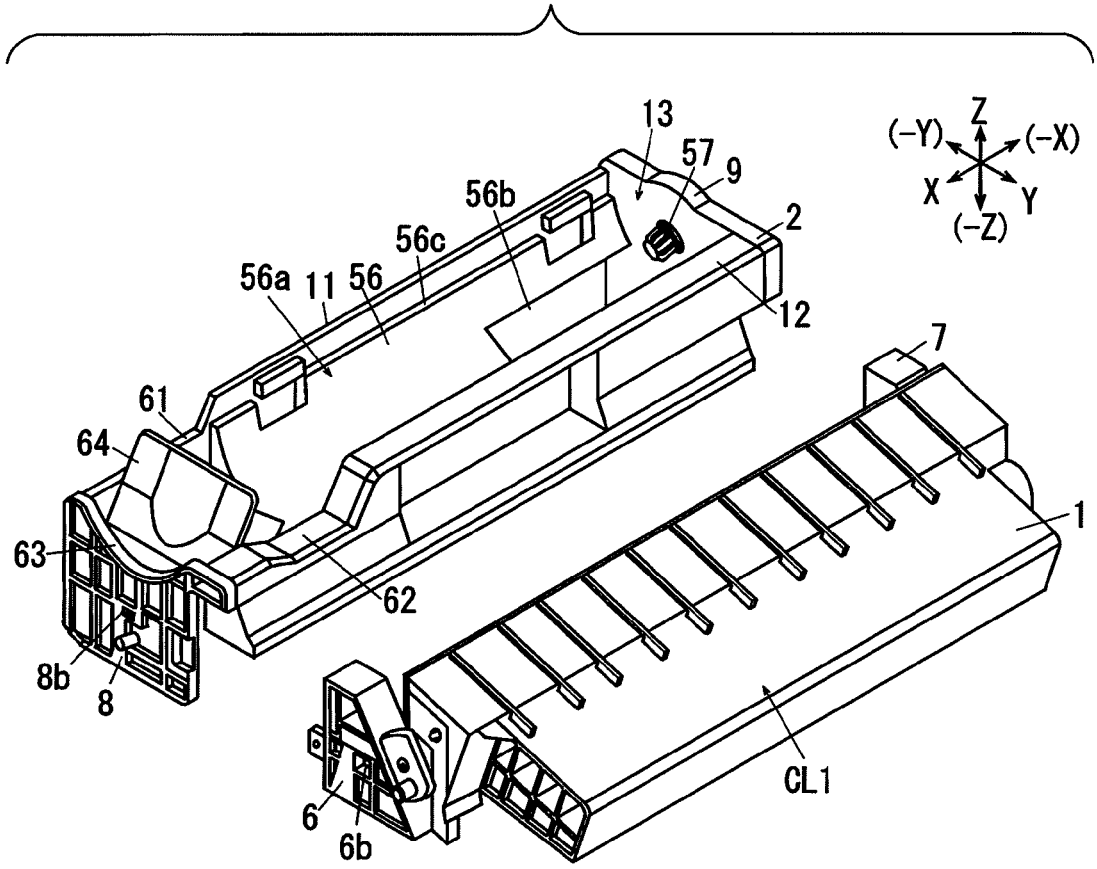
FIG. 4 is a perspective view of the process cartridge according to the first exemplary embodiment in a state that a cartridge holder and a photoreceptor body holder are separated from each other.

FIGS. 3A and 3B are perspective views of the process cartridge according to the first exemplary embodiment in a state that the toner cartridge TC is moved to a mounting position and in a state that the toner cartridge TC is moved to a detaching position, respectively. FIG. 4 is a perspective view of the process cartridge according to the first exemplary embodiment in a state that a cartridge holder and a photoreceptor body holder are separated from each other.

As shown in FIGS. 3A and 3B and FIG. 4, the toner image forming device G (process cartridge) according to the first exemplary embodiment is equipped with a right-hand photoreceptor body holder 1 (example image carrier support frame, example first holding member) which supports the photoreceptor body PR, the cleaner CL1, the charging roll CR, and the charging roll cleaner CRC. A cartridge holder 2 (example container support frame, example second holding member) is located on the left of and supported by the photoreceptor body holder 1. The cartridge holder 2 supports the toner cartridge TC.

(Developing Device)

Figure 5A:
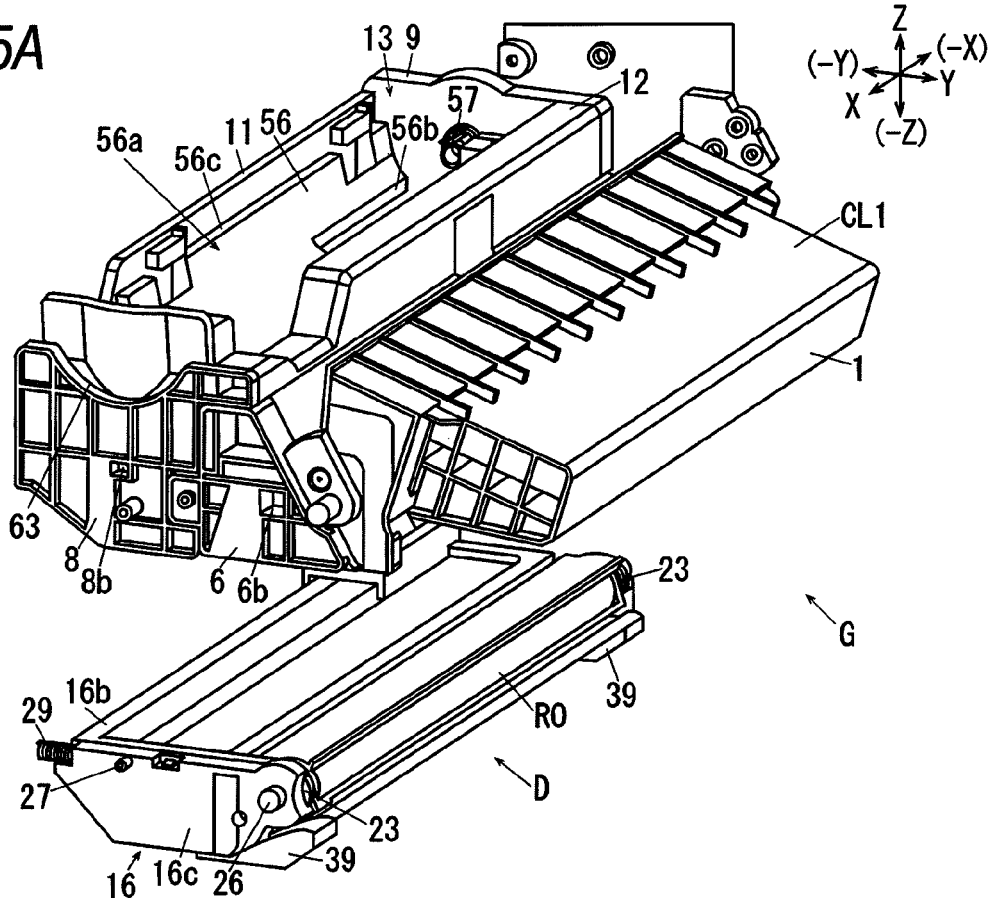
FIGS. 5A and 5B illustrate a state that a developing unit is detached from the process cartridge.
Figure 5B:
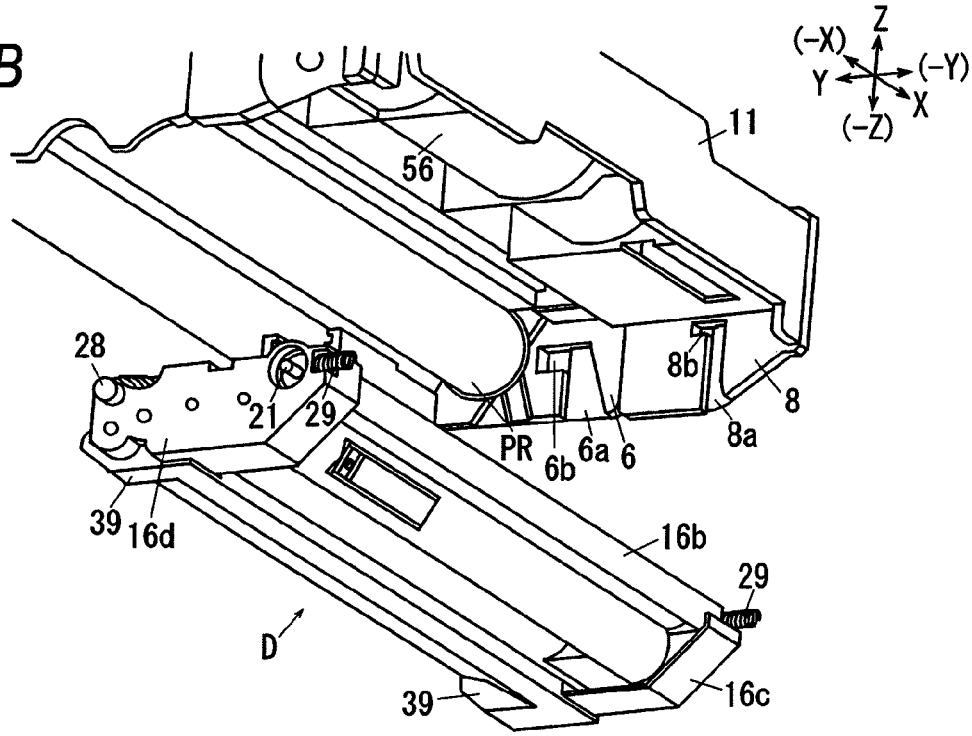
Figure 6A:
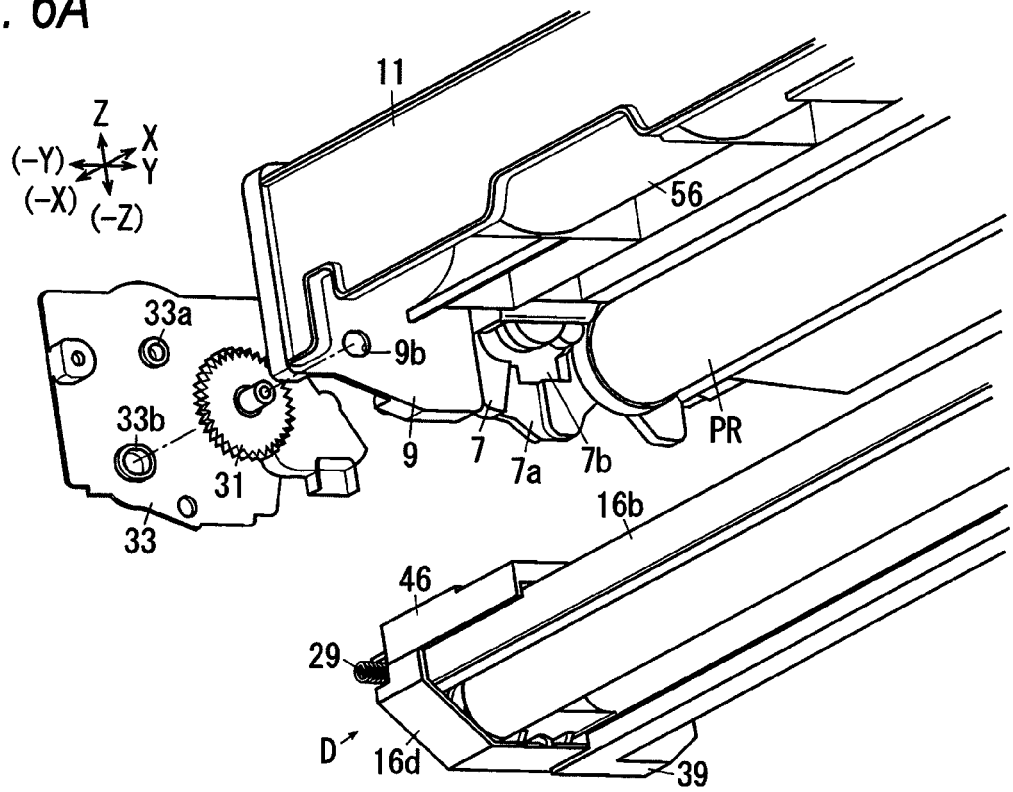
FIGS. 6A and 6B also illustrate a state that the developing unit is detached from the process cartridge.
Figure 6B:
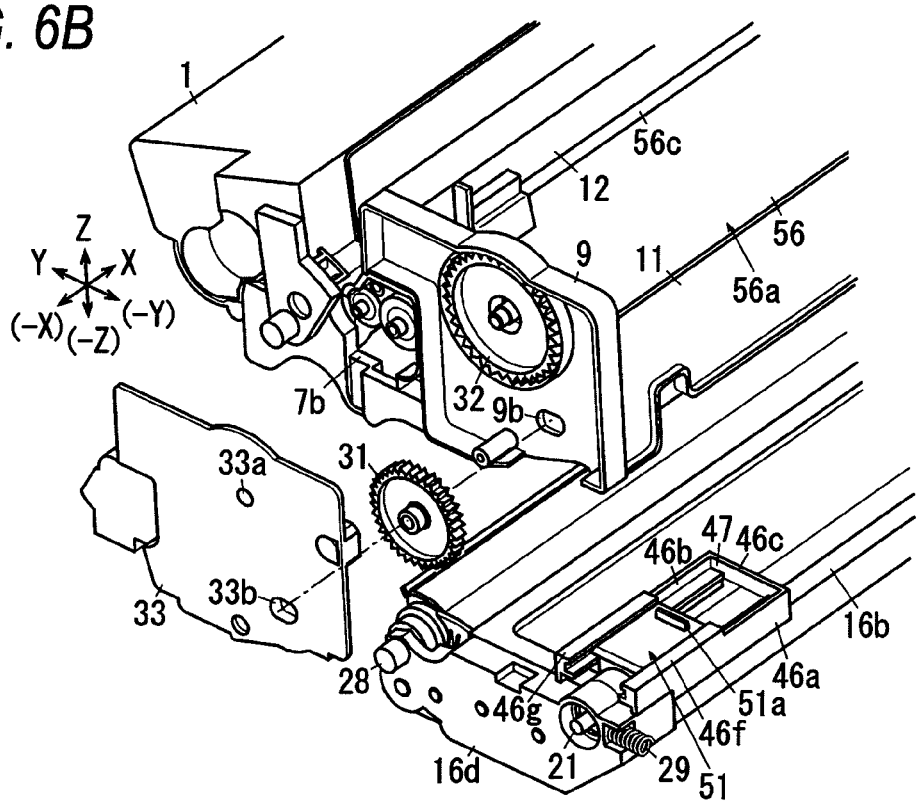

FIGS. 5A and 5B illustrate a state that a developing unit is detached from the process cartridge. FIG. 5A is a perspective view in which a front frame is viewed obliquely from the front side. FIG. 5B is a perspective view in which the front frame is viewed obliquely from the rear side. FIGS. 6A and 6B also illustrate a state that the developing unit is detached from the process cartridge. FIG. 6A is a perspective view in which a rear frame is viewed obliquely from the front side. FIG. 6B is a perspective view in which the rear frame is viewed obliquely from the rear side.

As shown in FIGS. 3A and 3B to FIGS. 6A and 6B, the photoreceptor body holder 1 is provided, on the left side, with a plate-like first front frame 6 (example front support frame) and first rear frame 7 (example rear support frame). The cartridge holder 2 is provided with a plate-like second front frame 8 (example front support frame) and second rear frame 9 (example rear support frame). In the cartridge holder 2, a pair of a left frame 11 and a right frame 12 which extend in the front-rear direction and are integrated with each other is provided between the second front frame 8 and the second rear frame 9. A cartridge holding room 13 (example mounting unit) which is to be mounted with the toner cartridge TC has the internal space that is surrounded by the frames 8-12.

As shown in FIG. 5B, the back surfaces of the front frames 6 and 8 are formed with front attachment grooves 6*a* and 8*a* (example front attachment portions) which extend upward from the bottom ends and front holding grooves 6*b* and 8*b* (example front holding portions) which extend rightward from the top ends of the front attachment grooves 6*a* and 8*a*, respectively.

As shown in FIG. 6A, the front surface of the first rear frame 7 is formed with a rear attachment groove 7*a* (example rear attachment portion) which extends upward from the bottom end and a rear holding groove 7*b* (example rear holding portion) which extends rightward from the top end of the rear attachment groove 7*a*. The second rear frame 9 is formed with a holding long hole 9*b* (example rear holding portion) which is long in the right-left direction.

The front frames 6 and 8 and the rear frames 7 and 9 constitute development support frames 6+7+8+9 which support the developing device D.

Figure 7:
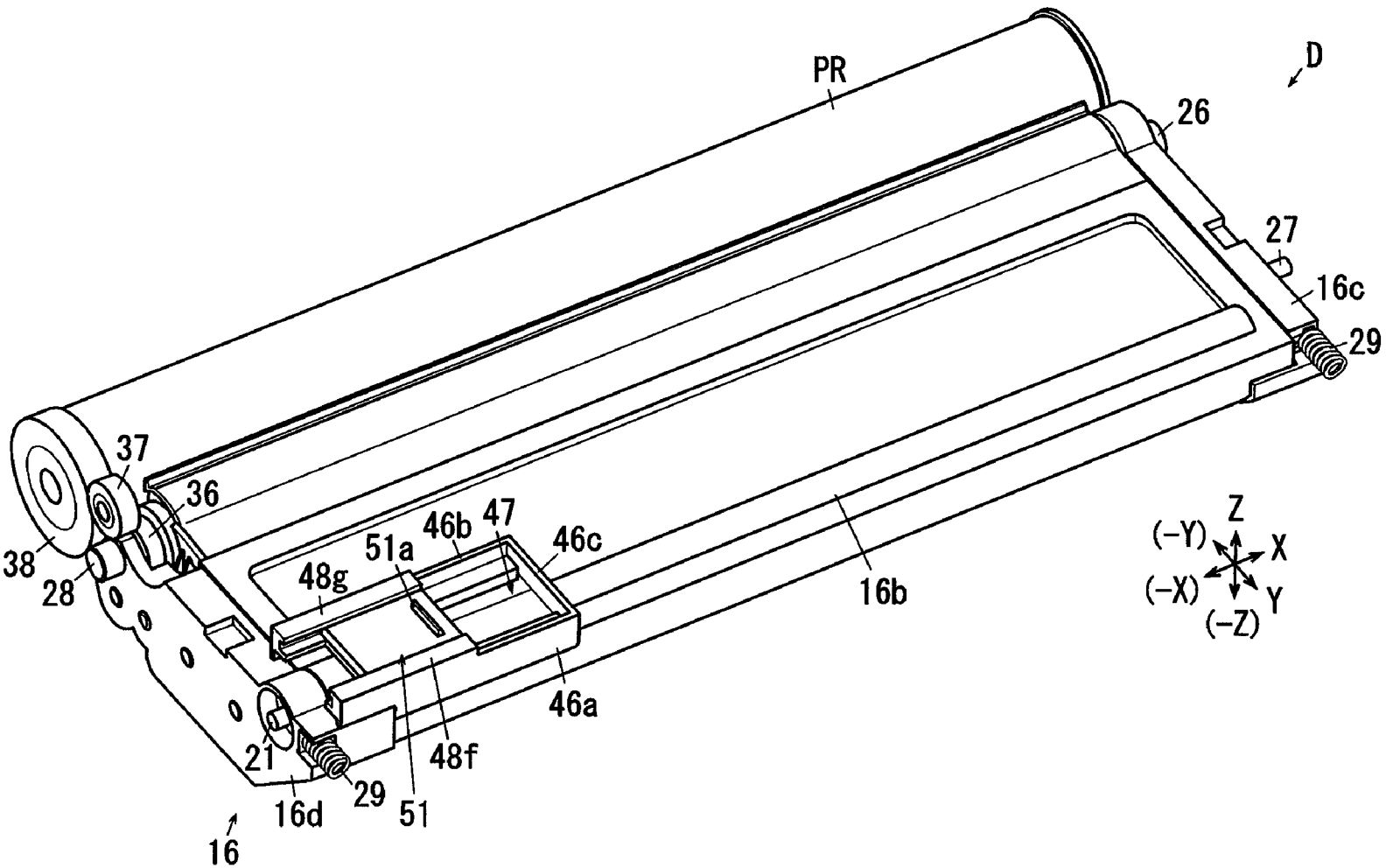
FIG. 7 is a perspective view of a developing device according to the first exemplary embodiment.

FIG. 7 is a perspective view of the developing device according to the first exemplary embodiment.

As shown in FIG. 2 and FIGS. 5A and 5B to FIG. 7, the developing device D according to the first exemplary embodiment is a developing unit which can be attached to and detached from the toner image forming device G. As shown in FIG. 2 and FIGS. 5A and 5B to FIG. 7, the developing device D according to the first exemplary embodiment is equipped with a developing device container 16 for transporting developer. The developing device container 16 has a lower, developing device container main body 16*a* and a lid member 16*b* which covers the developing device container main body 16*a* from above. As shown in FIG. 2, the developing roll R0, a transport paddle 17 (example supply member) for transporting developer to the developing roll R0, a pair of transport augers 18 and 19 (example stirring members) for circulating and transporting the developer in the developing device container 16 while stirring it, and a supply auger 21 (example supply member) which is disposed on the left of the left-hand transport auger 19 and supplies developer into the developing device container 16 from the toner cartridge TC by transporting it forward are supported rotatably in the developing device container 16. A cylindrical or circular-rod-shaped trimmer 22 (example layer thickness restricting member) for restricting the layer thickness of developer on the surface of the developing roll R0 is supported so as to be disposed on the top-left of the developing roll R0.

As shown in FIG. 5A, tracking rolls 23 (example contact portions) which are concentric with and larger in outer diameter than the developing roll R0 is supported rotatably at both (front and rear) ends of the developing roll Rd.

As shown in FIG. 5A, a front end wall 16*e* of the developing device container 16 is formed, in an integrated mariner, with a first front projection 26 and a second front projection 27 (example front hooding subject portions) which project forward so as to correspond to the respective front holding grooves 6*a* and 8*a*. As shown in FIGS. 5B, 6B, and 7, a rear end wall 16*d* of the developing device container 16 is formed with a rear projection 28 (example rear holding subject portion) which projects rearward so as to correspond to the rear holding groove 7*b*.

As shown in FIG. 2 and FIGS. 5A and 5B to FIG. 7, two (front and rear) coil springs 29 (example urging members) are disposed so as to extend leftward from the left ends of the front end wall 16*c* and the rear end wall 16*d* of the developing device container 16.

Therefore, in attaching the developing device D according to the first exemplary embodiment to the toner image forming device G, the front projections 26 and 27 and the rear projection 28 are caused to go up along the respective attachment grooves 6*a*-8*a* and then move rightward, whereby the projections 26-28 come to be held by the respective holding grooves 6*b*-8*b*. In the first exemplary embodiment, the holding grooves 6*b*-8*b* extend in the right-left direction, that is, in the direction in which the developing device D comes close to and goes away from the photoreceptor body PR, and hence the developing device D is held in a state that it can be moved in the right-left direction.

Since the left ends of the respective coil springs 29 are supported by the inner surface of the left frame 11 of the cartridge holder 2, the developing device D is urged toward the photoreceptor body PR by the coil springs 29. The two (front and rear) tracking rolls 23 of the developing device D are brought into contact with the two (front and rear) end surface portions (example contact subject portions) of the photoreceptor body PR, whereby the interval between the developing roll R0 and the photoreceptor body PR is kept at a preset value. As shown in FIGS. 6A and 6B, in this state, a supply gear 31 (example gear) whose rotary shaft penetrates through the holding long hole 9*b* and is connected to the rear end, in the axial direction, of the supply auger 21 is attached to the back surface of the second rear frame 9.

As shown in FIG. 6B, a cartridge gear 32 (example attachment/detachment body gear) to mesh with the supply gear 31 is disposed on the top-left side of the supply gear 31 and rotatably supported by the back surface of the second rear frame 9. A gear cover 33 (example gear protecting member) is supported so as to be disposed behind the supply gear 31 and the cartridge gear 32. The gear cover 33 is formed with a support circular hole 33*a* for rotatably supporting the rear end of the rotary shaft of the cartridge gear 32 and a support long hole 33*b* for supporting the rear end of the rotary shaft of the supply gear 31 in such a manner that the supply gear 31 is rotatable and movable in the right-left direction. Supported by the holding long hole 9*b* and the support long hole 33*b* which are long in the right-left direction, the supply gear 31 which is connected to the supply auger 21 is movable in the right-left direction relative to the second rear frame 9 and the gear cover 33. As such, the developing device D to which the supply gear 31 is connected is rendered movable in the direction in which it comes close to and goes away from the photoreceptor body PR. In the first exemplary embodiment, the supply gear 31 and the cartridge gear 32 are set so that their engagement is maintained even if the degree or position of engagement is deviated when the developing device D comes close to or goes away from the photoreceptor body PR (the movement distance is small).

Drive power is transmitted from a supply drive source (not shown) in the copier main body U1 to the cartridge gear 32 via the supply gear 31.

In the developing device D according to the first exemplary embodiment, as shown in FIG. 7, drive power that is transmitted to a development gear 36 (example gear) which is supported by the rear end of the developing roll R0 is transmitted to the developing roll R0, the transport paddle 17, and the transport augers 18 and 19 by a gear train (not shown) which is provided inside the rear end wall 16*d*, whereby the members 17-19 are rotated. Drove power is transmitted to the development gear 36 from a photoreceptor body gear 38 (example gear) which is supported by the rear end of the photoreceptor body PR via an intermediate gear 37 which is supported by the first rear frame 7. Drove power is transmitted from a drive source (not shown) in the copier main body U1 to the photoreceptor body gear 38.

As shown in FIG. 2, a top guide 39 (example medium guide member) is provided at the bottom of the developing device D so as to extend toward the photoreceptor body PR and to serve as a top part of the pre-transfer sheet guide SG1. The two (front and rear) ends of the top guide 39 are supported by the first front frame 6 and the first rear frame 7, respectively, which are left-hand portions of the photoreceptor body holder 1. Therefore, in the first exemplary embodiment, the pre-transfer sheet guide SG1 is not supported by the developing device D but by the photoreceptor body holder 1. This makes less serious a problem that impact that is caused when a sheet S being conveyed toward the transfer region Q4 contacts the pre-transfer sheet guide SG1 is transmitted to the developing device D and causes image quality disorder such as a development failure.

(Inlet Shutter and its Neighborhood)

Figure 8A:
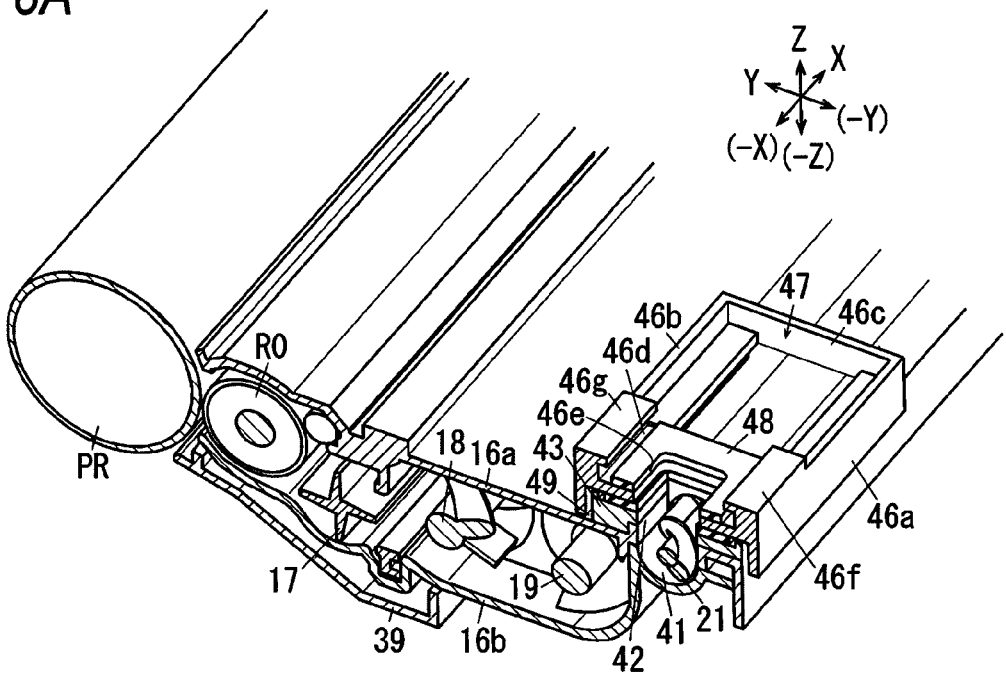
FIGS. 8A and 8B illustrate a developer inlet and its neighborhood according to the first exemplary embodiment.
Figure 8B:
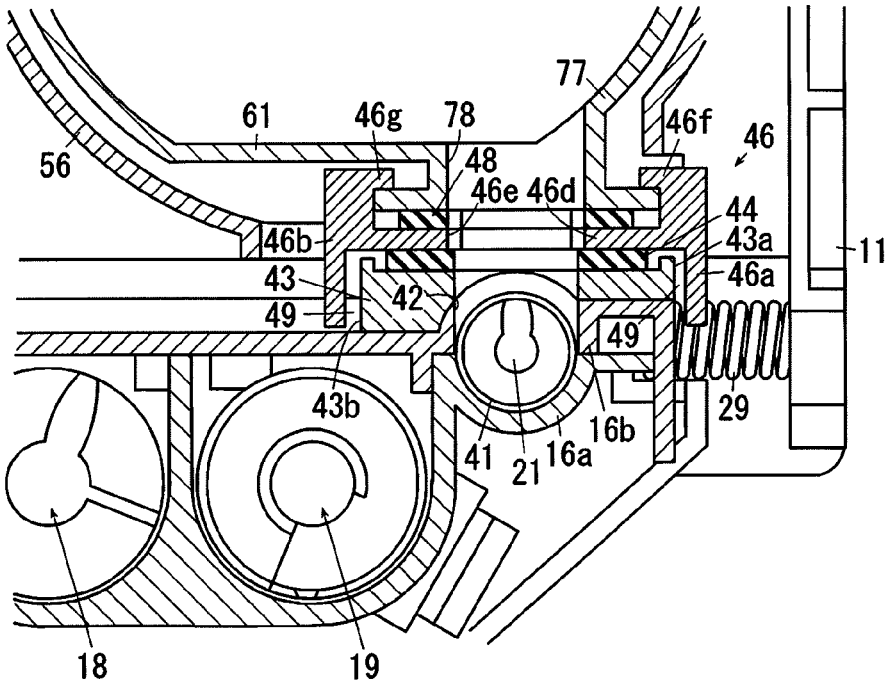

FIGS. 8A and 8B illustrate a developer inlet and its neighborhood according to the first exemplary embodiment. FIG. 8A is a partially sectional perspective view of a part of the process cartridge in a state that an inlet shutter is removed, and FIG. 8B is a sectional view of the process cartridge in a state the toner cartridge is mounted.

As shown in FIG. 7 and FIGS. 8A and 8B, a developer inlet 42 penetrates vertically through a rear-left end portion of the lid member 16*b* of the developing device container 16 from a rear end portion of a supply path 41 where the supply auger 21 is provided.

A spacer 43 (example sealing maintaining member) having a flat top surface is supported so as to surround the inlet 42. A bottom seal 44 (example first sealing member) is fixed to and supported by the top surface of the spacer 43 so as to surround the inlet 42. The bottom seal 44 of the first exemplary embodiment is elastically deformable being made of an elastic material such as a urethane resin or a rubber.

A shutter guide 46 (example hole connection member) is supported by the top surface of the bottom seal 44 so as to extend in the front-rear direction. As shown in FIGS. 7 and 8A, the shutter guide 46 has a pair of a left side wall 46*a* and a right side wall 46*b* and a front side wall 46*c* which connect the front ends of the left side wall 46*a* and the right side wall 46*b*. A plate-like connection portion 46*d* is connected to rear portions of the left side wall 46*a* and the right side wall 46*b* and is formed so as to surround the inlet 42. A connection hole 46*e* is formed in the connection portion 46*d* so as to be connected to the inlet 42. The left side wall 46*a* and the right side wall 46*b* are formed, between their rear ends and the front end of the connection portion 46*d*, with respective guide rails 46*f* and 46*g* (example guide portions) which project inward in the right-left direction. The space surrounded by the left side wall 46*a*, the right side wall 46*b*, the front side wall 46*c*, and the front surface of the connection portion 46*d* is the space of an outlet insertion room 47.

As shown in FIGS. 8A and 8B, a top seal 48 (example second sealing member) is supported by the connection portion 46*d* so as to surround the connection hole 46*e*. Like the bottom seal 44, the top seal 48 of the first exemplary embodiment is made of an elastic material.

As shown in FIG. 8B, gaps 49 (example movement allowing spaces) are formed between the left side wall 46*a* and the left side surface 43*a* of the spacer 43 and between the right side wall 46*b* and the right side surface 43*b* of the spacer 43. As such, the shutter guide 46 is supported so as to be movable in the right-left direction by the right-left width of each gap 49 due to elastic deformation or shear deformation of the bottom seal 44, a slip at a boundary surface, or a like phenomenon. In the first exemplary embodiment, the right-left width of the connection hole 46*e* is wider than the width of the inlet 42 by a movable distance.

Figure 9A:
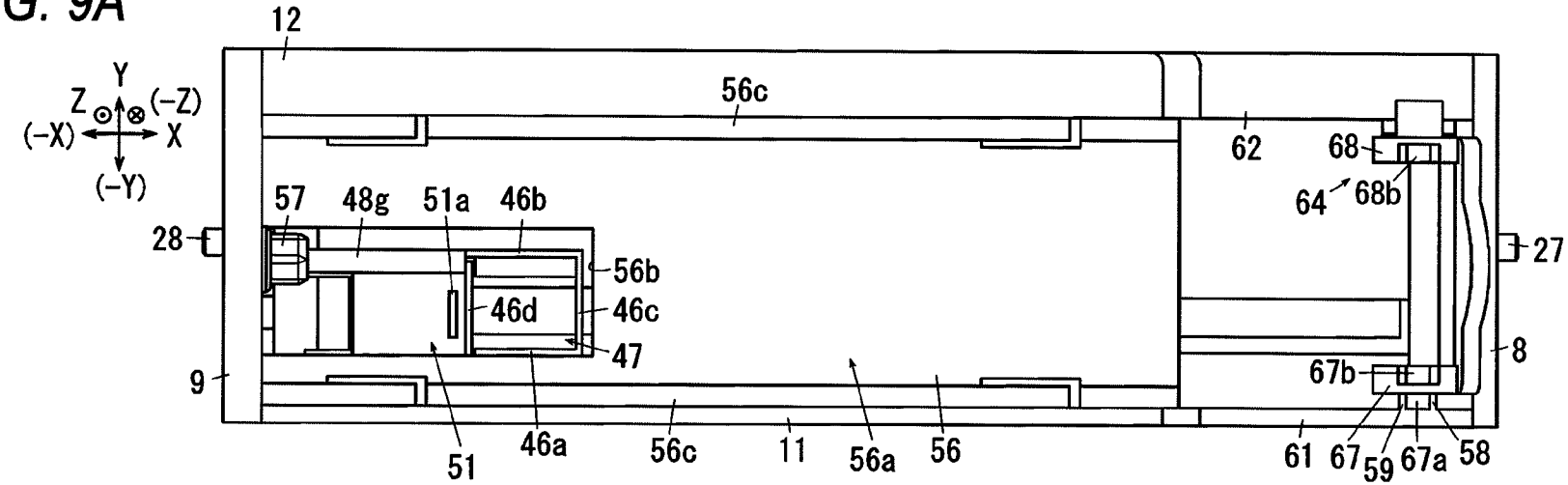
FIGS. 9A and 9B are plan views of the cartridge holder according to the first exemplary embodiment in a state that the inlet shutter is moved to a closing position and in a state that the inlet shutter is moved to an opening position, respectively.
Figure 9B:
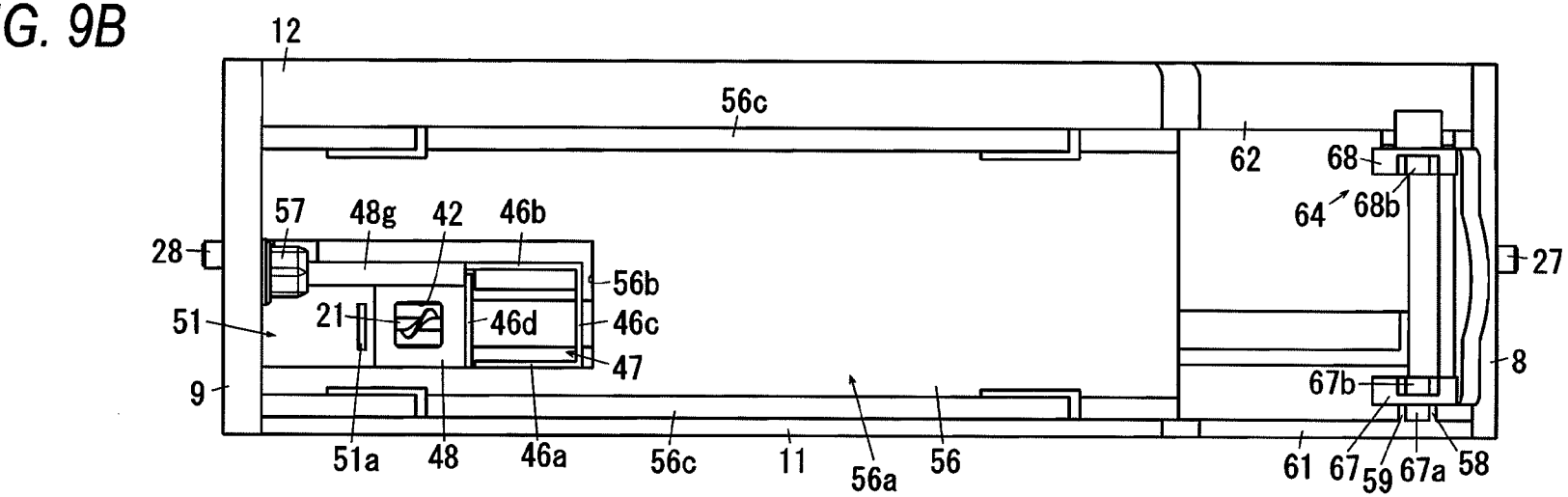

FIGS. 9A and 9B are plan views of the cartridge holder according to the first exemplary embodiment in a state that the inlet shutter is moved to a closing position and in a state that the inlet shutter is moved to an opening position, respectively.

As shown in FIG. 7 and FIGS. 9A and 9B, a plate-like inlet shutter 51 (example inlet opening/closing member) is supported by the guide rails 46*f* and 46*g* so as to be movable in the front-rear direction. The inlet shutter 51 is movable in the front-rear direction with its bottom surface in close contact with the top seal 48, and is supported so as to be movable between the closing position where it closes the inlet 42 (see FIGS. 7 and 9A) and the opening position where it opens the inlet 42 (see FIG. 9B). The top surface of the inlet shutter 51 is formed, at a front position, a projection 51*a* (example engagement portion) which projects upward.

As shown in FIGS. 2, 4, 5A, 6B, 8B, 9A, and 9B, a bottom wall member 56 which is convex downward is fixed to and supported by a bottom portion of the cartridge holding room 13 which is formed by the second front frame 8, the second rear frame 9, the left frame 11, and the right frame 12. As shown in FIGS. 9A and 9B, a cartridge support surface 56*a* (example container support surface) is formed by the top surface of the bottom wall member 56. A rear end portion of the bottom wall member 56 is formed with an opening 56*b* for rendering the shutter guide 46 accessible from above. As shown in FIG. 4 and FIGS. 9A and 9B, a top end portion of the bottom wall member 56 is formed with a stepped cartridge guide 56*c* (example container guide portion) which extends in the front-rear direction.

A drive coupler 57 (example drive power transmission member) which is coupled to the cartridge gear 32 and thereby receive drive power is supported rotatably by the second rear frame 9.

As shown in FIGS. 3A and 3B, a front end portion of the cartridge holding room 13 is formed with detachment maintaining ribs 58 (example detachment maintaining portions) which project inward from the left frame 11 and the right frame 12, respectively, and extend in the top-bottom direction. And mounting maintaining ribs 59 are formed behind the respective detachment maintaining ribs 58 so as to extend parallel with the respective detachment maintaining ribs 58.

Front portions of the left frame 13. and the right frame 12 are formed with cuts 61 and 62 so that the tops of the left frame 11 and the right frame 12 are lower in their front portions than in their central and rear portions. With this measure, when an operator lifts up the toner cartridge TC by pinching its front end portion with his or her fingers, the fingers can easily reach the front end portion; the ease of operation is thus enhanced. Furthermore, a top portion of the second front frame 8 is formed with an arc-shaped front cut 63.

As shown in FIGS. 3A and 3B to FIGS. 6A and 6B and FIGS. 9A and 9B, an attachment/detachment lever 64 (example attachment/detachment manipulation portion) is supported in a front end portion of the cartridge holding room 13. The attachment/detachment lever 64 has a front, plate-like lever main body 66 and a lever left portion 67 and a lever right portion 68 which extend rearward from the left and right ends of the lever main body 66.

As shown in FIGS. 3A and 3B, the attachment/detachment lever 64 is supported so as to be rotatable on rotation centers 64*a* which project from bottom portions of the lever left portion 67 and the lever right portion 68 between a mounting position (see FIG. 3A) and a detaching position (see FIG. 3B).

As shown in FIGS. 3A and 3B and FIGS. 9A and 9B, a top portion of the lever main body 66 is formed with a lever handle 66*a* (example pinching portion) which is shaped so as to be convex forward and to thereby be pinched easily by an operator. The lever handle 66*a* is put in the cut 63 when the attachment/detachment lever 64 is located at the detaching position.

As shown in FIGS. 9A and 9B, the lever left portion 67 and the lever right portion 68 are formed with respective lock projections 67*a*. (example position maintaining members) which project outward so as to correspond to the detachment maintaining ribs 58 and the mounting maintaining ribs 59. Only the left-hand lock projection 67*a* is shown in FIGS. 9A and 9B.

Therefore, in a state that the attachment/detachment lever 64 is moved to the detaching position, the lock projections 67*a* are sandwiched between the detachment maintaining ribs 58 and the mounting maintaining ribs 59, where by the attachment/detachment lever 64 is kept at the detaching position. As the attachment/detachment lever 64 is moved toward the mounting position, the lock projections 67*a* are brought into contact with the mounting maintaining ribs 59, the left frame 11 and the right frame 12 are deformed elastically to increase their interval, and the lock projections 67*a* move rearward climbing over the mounting maintaining ribs 59. The attachment/detachment lever 64 is thus moved to the mounting position and kept there.

As shown in FIGS. 3A and 3B and FIGS. 9A and 9B, the lever left portion 67 and the lever right portion 68 are formed, inside, with cartridge link motion grooves 67*b* and 68*b* (example link motion portions) which extend in the top-bottom direction.

Figure 10:
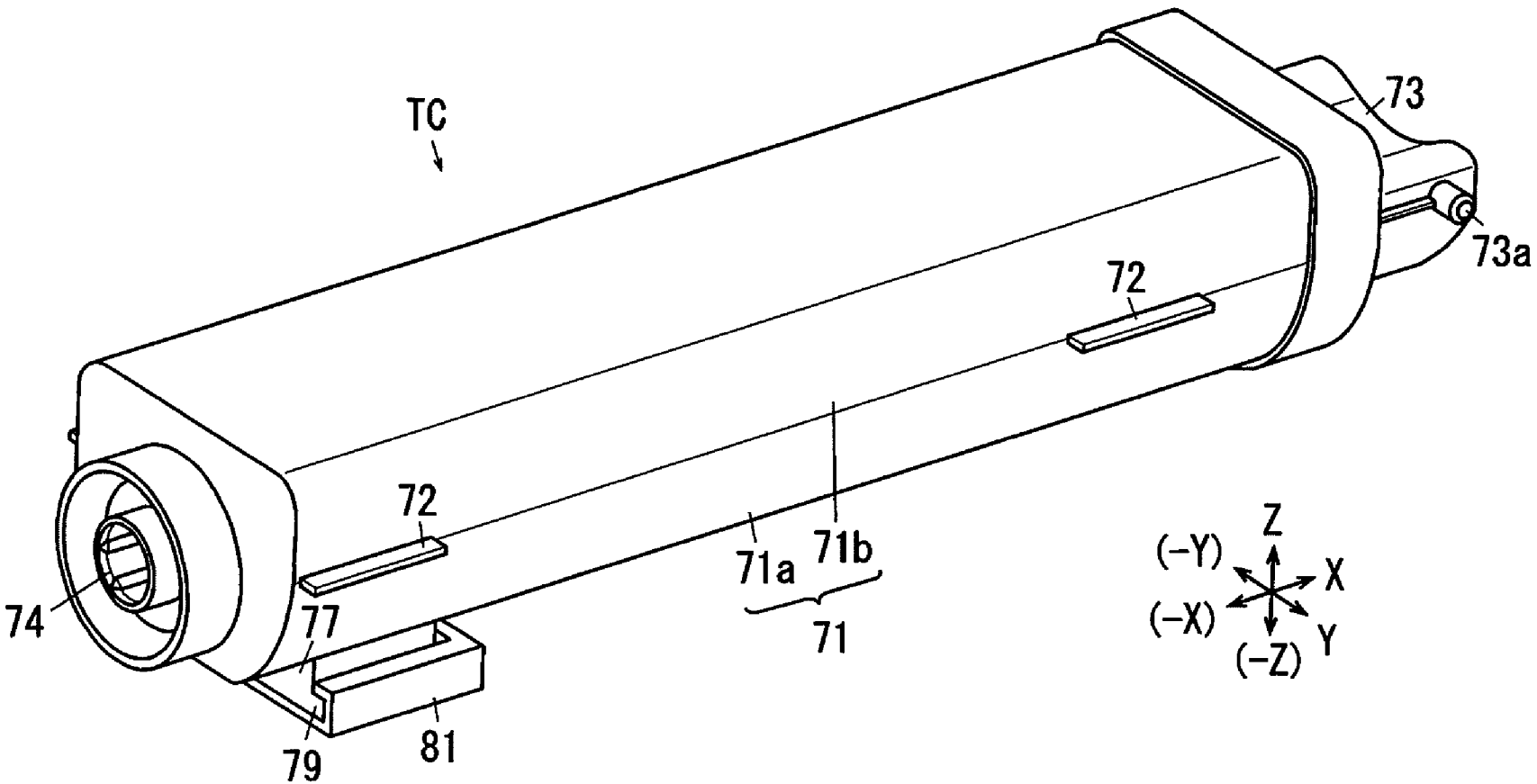
FIG. 10 is a perspective view of the toner cartridge according to the first exemplary embodiment as viewed obliquely from the rear side.
Figure 11A:
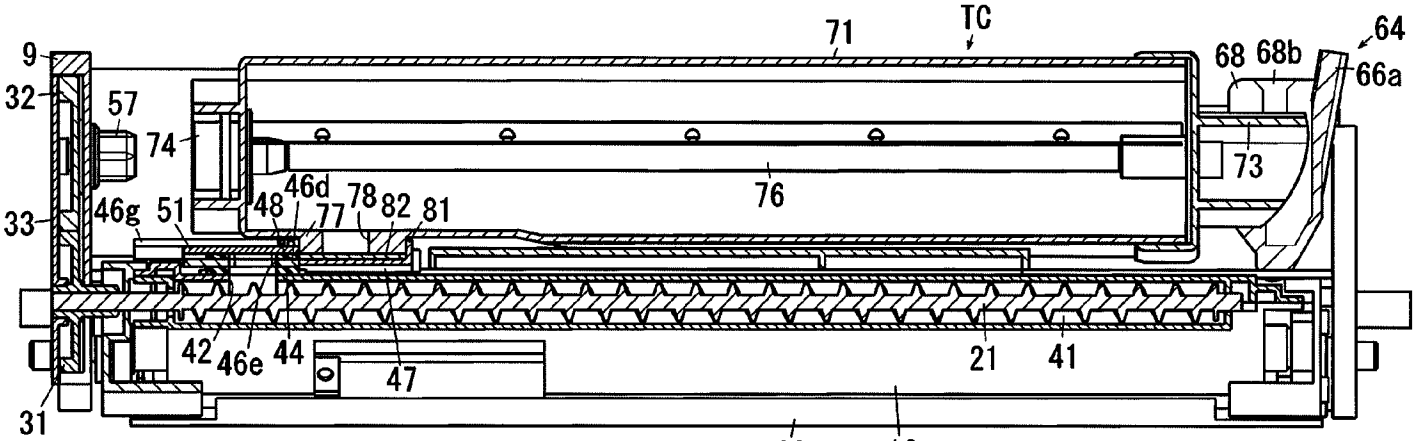
FIGS. 11A and 11B illustrate a state that the toner Cartridge according to the first exemplary embodiment is moved to the detaching position and in a state that it is moved to the mounting position, respectively.
Figure 11B:
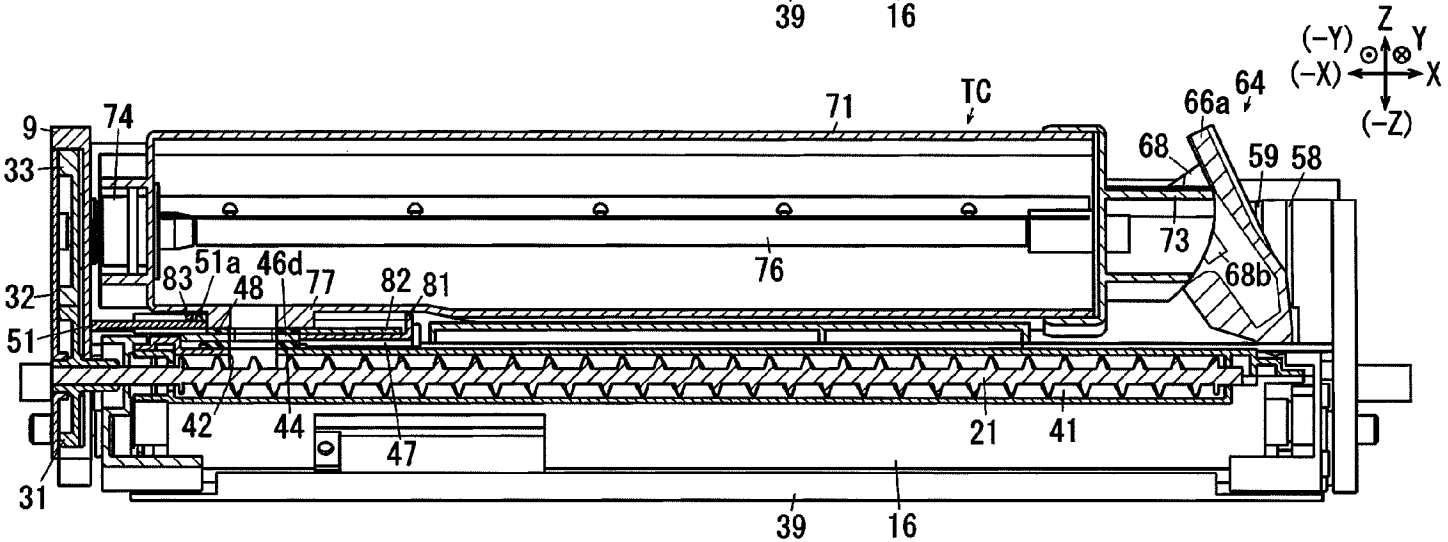
Figure 12A:
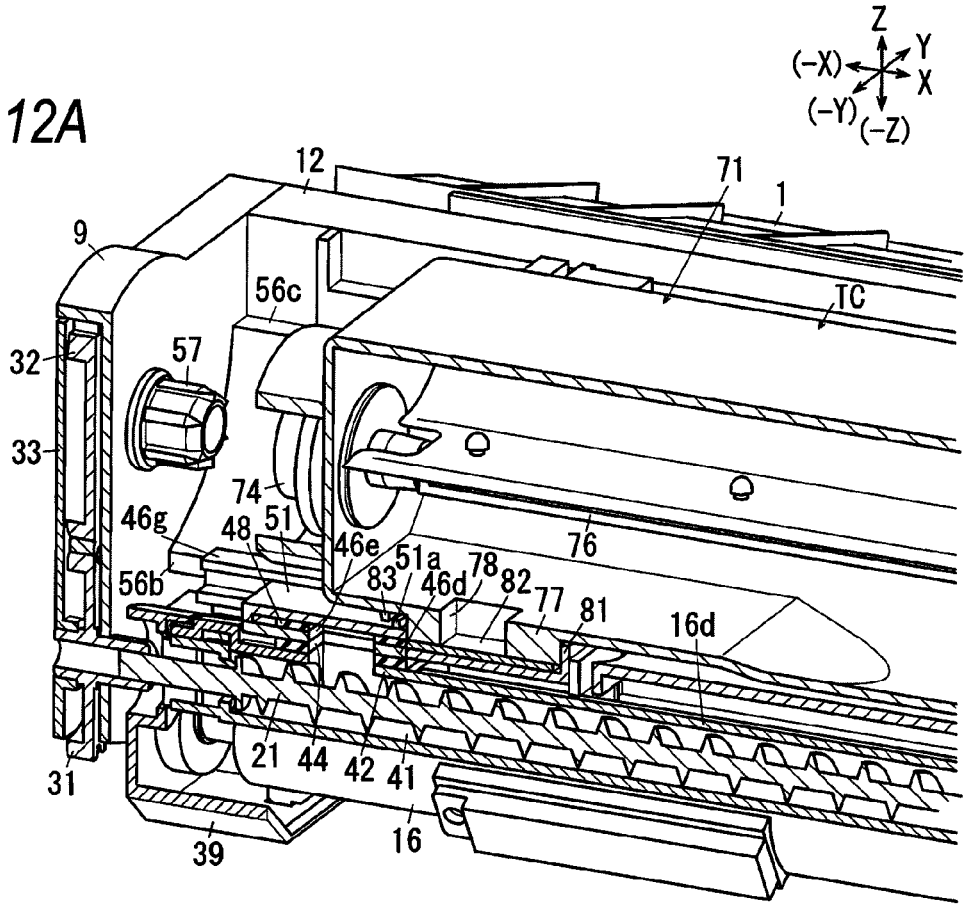
FIGS. 12A and 12B illustrate a part including the developer inlet and a developer outlet in a state that the toner cartridge is moved to the detaching position and in a state that it is moved to the mounting position, respectively.
Figure 12B:
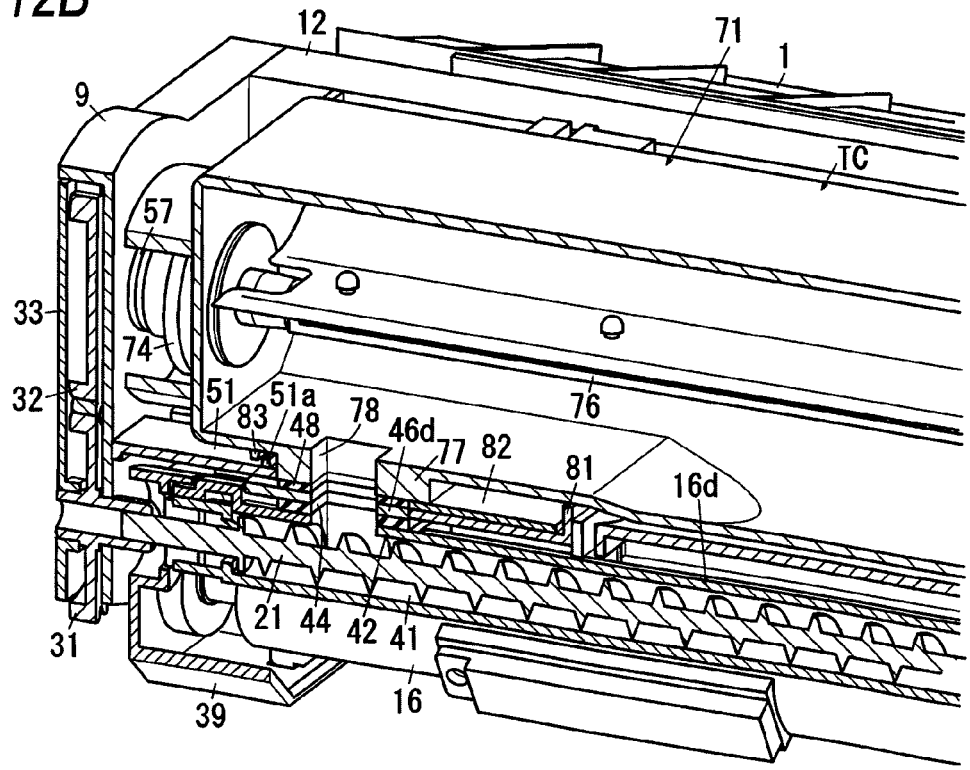

FIG. 10 is a perspective view of the toner cartridge TC according to the first exemplary embodiment as viewed obliquely from the rear side. FIGS. 11A and 11B illustrate a state that the toner cartridge TC according to the first exemplary embodiment is moved to the detaching position and a state that it is moved to the mounting position, respectively. FIGS. 12A and 12B illustrate a part including the developer inlet and the developer outlet in a state that the toner cartridge TC is moved to the detaching position and in a state that it is moved to the mounting position, respectively.

As shown in FIGS. 3A and 3B and FIG. 10 to FIGS. 12A and 12B, the toner cartridge TC according to the first exemplary embodiment has a generally cylindrical cartridge main body 71 (example container main body) which contains a developer. In the cartridge main body 71, a lower portion 71*a* has a semi-cylindrical shape that conforms to the cartridge support surface 56*a* and an upper portion 71*b* is shaped like a half of a rectangular pipe.

As shown in FIG. 10, two pairs of guide subject portions 72 which extend in the front-rear direction and project outward (i.e., in the right-left direction) are formed at the boundary between the lower portion 71*a* and the upper portion 71*b* of the cartridge main body 71. Only the left-hand pair of guide subject portions 72 is shown in FIG. 10. The two pairs of guide subject portions 72 are formed so as to correspond to the respective cartridge guides 56*c*. In a state that the toner cartridge TC is housed in the cartridge holding room 13, the guide subject portions 72 are guided in the front-rear direction by the cartridge guides 56*c*.

As shown in FIG. 10 to FIGS. 12A and 12B, a cartridge handle 73 (example container manipulation portion) is supported by the front end portion of the cartridge main body 71 so as to project forward. As shown in FIG. 10, link motion projections 73*a* (example link motion subject portions) project outward (i.e., in the right-left direction) from both (right and left) end portions of the cartridge handle 73. Only the left-hand link motion projection 73*a* is shown in FIG. 10. Formed so as to correspond to the respective cartridge link motion grooves 67*b* and 68*b*, the link motion projections 73*a* are inserted (fitted) into the cartridge link motion grooves 67*b* and 68*b* when the toner cartridge TC is mounted into the cartridge holder 2 from above.

As shown in FIG. 10 to FIGS. 12A and 12B, a follower coupler 74 (example transmission subject member) to be engaged with the drive coupler 57 is supported by the rear end portion of the cartridge main body 71. As shown in FIGS. 11A and 11B and FIGS. 12A and 12B, a cartridge paddle 76 (example stirring transport member) is disposed inside the cartridge main body 71 so as to be connected to the front end of the follower coupler 74 and extend in the front-rear direction. As shown in FIG. 2, FIGS. 11A and 11B, and FIGS. 12A and 12B, the cartridge paddle 76 has a rotary shaft 76*a* which extends in the front-rear direction. A transport film 76*b* (example transport member main body) which is a thin-film flexible member is supported by the rotary shaft 76*a*. Oblique cuts (not shown) are formed in the transport film 76*b*, whereby the transport film 76*b* can transport developer rearward as it is rotated. Such transport films are known being disclosed in JP-A-2007-298715, JP-A-2007-298789, etc., and hence will not be described or illustrated further.

As shown in FIG. 10 to FIGS. 12A and 12B, an outlet portion 77 is formed at the rear end of the lower portion 71*b* of the cartridge main body 71 so as to project downward. A developer outlet 78 for connecting the inside and the outside of the cartridge main body 71 is formed through the outlet portion 77. As shown in FIG. 10, the outlet portion 77 is formed with outlet shutter guides 79 (example opening/closing guide portions which project outward (i.e., in the right-left direction) and extend in the front-rear direction.

An outlet shutter 81 (example outlet opening/closing member) is supported by the outlet shutter guides 79 so as to be movable in the front-rear direction between an outlet closing position (see FIGS. 11A and 12A) where it closes the outlet 78 and an outlet opening position (see FIGS. 11B and 12B) where it opens the outlet 78. As shown in FIGS. 11A and 11B and FIGS. 12A and 12B, an outlet seal 82 (example outlet sealing member) is supported by the top surface of the outlet shutter 81.

The sizes of the outlet portion 77 and the outlet shutter 81 of the first exemplary embodiment are set so that they are fitted into the outlet insertion room 47 when the toner cartridge TC is inserted into the cartridge holding room 13 from above. The thickness, in the top-bottom direction, of the outlet shutter 81 is set so as to correspond to the thickness of the connection portion 46*d* of the shutter guide 46.

A projection 83 (example engagement subject portion) projects downward from a portion, behind the outlet portion 77, of the lower portion 71*b* of the cartridge main body 71 so as to correspond to the projection Sla of the inlet shutter 51. The projection 83 of the cartridge main body 71 is set so as to come into contact with the back side of the projection 51*a* of the inlet shutter 51.

(Work of Attaching/Removing the Toner Cartridge)

To attach the toner cartridge TC to the toner image forming device G, the toner cartridge TC is inserted into the cartridge holding room 13 from above and moved to the detaching position (see FIGS. 11A and 12A) in a state that the attachment/detachment lever 64 has been moved to the front, detaching position. At this time, the link motion projections 73*a* of the toner cartridge TC are inserted (fitted) into the respective cartridge link motion grooves 67*b* and 68*b* and the outlet portion 77 and the outlet shutter 81 are inserted (fitted) into the outlet insertion room 47.

When the operator rotates the attachment/detachment lever 64 rearward in the state that the toner cartridge TC is located at the detaching position (see FIGS. 11A and 12A), the front end of the cartridge handle 73 of the toner cartridge TC is pushed by the back surface of the attachment/detachment lever 64, whereby the toner cartridge TC is moved rearward. The follower coupler 74 is coupled with the drive coupler 57 to establish a drive power transmittable state.

In a state that the toner cartridge TC has been moved to the mounting position, the lock projections 67*a* of the attachment/detachment lever 64 are in contact with the rear, mounting maintaining ribs 59, respectively, to prevent the attachment/detachment lever 64 from rotating forward due to vibration or the like. The developer outlet 78 is thus prevented from being separated from the developer inlet 42.

As the toner cartridge TC is moved in the above manner, the outlet portion 77 is moved rearward but the outlet shutter 81 is not; the rearward movement of the outlet shutter 81 is prevented by the front end surface of the connection portion 46*d* of the shutter guide 46. Therefore, the outlet shutter 81 is moved relative to the outlet 78, that is, moved from the outlet closing position to the outlet opening position. The outlet 78 is thus opened. As the outlet portion 77 is moved rearward, the inlet shutter 51 is also moved rearward being pushed by the rear end surface of the outlet portion 77. Therefore, the inlet shutter 51 is moved relative to the inlet 42, that is, moved from the inlet closing position to the inlet opening position. The inlet 42 is thus opened. When the toner cartridge TC has moved to the mounting position (rear end), as shown in FIGS. 11B and 12B the inlet 42, the connection hole 46*e*, and the outlet 78 are connected to each other to establish a state that developer can flow into the supply path 91 from the toner cartridge TC.

To remove the toner cartridge TC, when the attachment/detachment lever 64 is moved from the mounting position (see FIGS. 11B and 12B) to the front, detaching position (see FIGS. 11A and 12A), the toner cartridge TC is moved to the front, detaching position because the link motion projections 73*a* are fitted in the respective cartridge link motion grooves 67*b* and 68*b*. As a result, the follower coupler 74 disengaged from the drive coupler 54.

When the attachment/detachment lever 64 has been moved to the detaching position, the lock projections 67*a* of the attachment/detachment lever 64 are sandwiched between the mounting maintaining ribs 59 and the detachment maintaining ribs 58, whereby the attachment/detachment lever 64 is kept at the detaching position. Therefore, the attachment/detachment lever 64 is prevented from rotating toward the mounting position due to its own weight, vibration, or the like.

As the toner cartridge TC is moved, the outlet portion 77 is moved forward but the outlet shutter 81 is not; the outlet shutter 81 is held in the outlet insertion room 47. Therefore, the outlet shutter 81 is moved relative to the outlet 78, that is, moved from the outlet opening position to the outlet closing position. The outlet 78 is thus closed.

As the toner cartridge TC is moved forward, the projection 83 of the cartridge main body 71 is hooked on the projection 51*a* of the inlet shutter 51 and hence the inlet shutter 51 is pushed forward by the toner cartridge TC and moved together with it. Therefore, as the toner cartridge TC is moved from the mounting position to the detaching position, the inlet shutter 51 is moved from the inlet opening position to the inlet closing position. The inlet 42 is thus closed.

When the toner cartridge TC has been moved to the detaching position, it is rendered removable upward. That is, the operator can remove the toner cartridge TC upward for replacement by pinching the cartridge handle 73. At this time, the operator can easily pinch the cartridge handle 73 because he or she can easily insert fingers through the cuts 61 and 62. In the first exemplary embodiment, the toner cartridge TC can be attached or detached by lowering or elevating it with respect to the cartridge holding room 13 without the need for inclining it (Workings of Exemplary Embodiment 1)

In the above-configured copier U according to the first exemplary embodiment, when developer is consumed in the developing device D by image formation in a state that the toner cartridge TC is held at the mounting position, the cartridge paddle 76 in the toner cartridge TC and the supply auger 21 are driven, whereby developer is supplied from the toner cartridge TC to the developing device D. When the developer in the toner cartridge TC has been used up, the toner cartridge TC is replaced by moving it to the detaching position.

The developing device D according to the first exemplary embodiment is supported so as to be movable in the direction in which it comes close to and goes away from the photoreceptor body PR, and their interval is maintained by the tracking rolls 23' s contacting the photoreceptor body PR. In the conventional configuration in which the gaps 49 are not provided, the shutter guide 46 and the developing device D are moved together . Therefore, if the shutter guide 46 is displaced due to play at the time of mounting of the toner cartridge TC, accumulation of errors, etc., the developing device D is displaced together with it . A resulting failure of the contact between the tracking rolls 23 and the photoreceptor body PR may cause an error in the interval between the developing roll R0 and the photoreceptor body PR. This may cause a development failure due to what is called a tracking failure, resulting in image degradation.

In contrast, in the toner image forming device G according to the first exemplary embodiment, by virtue of the gaps 49, the shutter guide 46 is supported so as to be movable with respect to the developing device D. Even if the shutter guide 46 is displaced, the developing device D is moved relative to the shutter guide 46, whereby proper tracking is secured. As a result, the probability of occurrence of a development failure due to a tracking failure is reduced and hence that of image quality degradation is lowered.

During, for example, an image forming operation, when the developing device D receives force for moving it due to, for example, eccentricity of the rotating photoreceptor body PR or tracking rolls 23, the developing device D is moved relative to the shutter guide 46. Therefore, neither the shutter guide 46 nor the toner cartridge TC is displaced and hence no undesirable force acts on the toner cartridge TC and the engagement between the couplers 57 and 74 receive no adverse influence. As such, the degree of adverse influence of a variation in the developing device D on the toner cartridge TC is lower than in the conventional configuration in which the shutter guide 46 is not moved relative to the developing device D.

In the toner image forming device G according to the first exemplary embodiment, the inlet shutter 51 is supported by the shutter guide 46. Not supported directly by the developing device D, the inlet shutter 51 is movable relative to the developing device D. Therefore, even if the shutter guide 46 is displaced relative to the developing device D, the inlet shutter 51 is not displaced relative to the toner cartridge TC. If the inlet shutter 51 were displaced relative to the outlet portion 77 of the toner cartridge TC, the inlet shutter 51 might not move smoothly (e.g., it might be hooked on something) during work of attaching or removing the toner cartridge TC. In contract, the toner image forming device G according to the first exemplary embodiment is configured so that attachment/removal work can be performed smoothly.

Furthermore, the shutter guide 46 is moved because, for example, the bottom seal 44 is deformed. The probability of occurrence of a tracking failure is thus lowered by the simple structure.

In the first exemplary embodiment, since the top guide 39 is held by the developing device D which is held in place with respect to the photoreceptor body PR, the sheet S that is guided by the top guide 39 is conveyed stably toward the photoreceptor body PR and image transfer from the photoreceptor body PR to the sheet S is performed stably.

In the first exemplary embodiment, the toner cartridge TC is moved between the mounting position and the detaching position by a manipulation of the attachment/detachment lever 64; the toner cartridge TC is not moved by an operator's manipulating it directly. This lowers the probability that the shutter 51 or 81 is not opened or closed or the couplers 57 and 74 are not engaged with each other when the toner cartridge TC is attached or removed because of, for example, inclination of the toner cartridge TC. The accuracy and the ease of operation of attachment/removal of the toner cartridge TC are thus increased.

In the first exemplary embodiment, the toner cartridge TC is moved in the front-rear direction, which is the longitudinal direction of the toner cartridge TC. Therefore, the toner cartridge TC less likely inclines or rolls and can be mounted more easily than in the case where it is moved in the shorter-axis direction.

Furthermore, in the first exemplary embodiment, since the toner cartridge TC movement direction is the same as the direction in which the couplers 57 and 74 are engaged with and disengaged from each other, no mechanism for allowing the couplers 57 and 74 to escape when the toner cartridge TC is moved is necessary. This simplifies the configuration of the toner image forming device G. Since no manipulation for, for example, allowing the couplers 57 and 74 to escape is necessary when the toner cartridge TC is attached or removed, the ease of operation is increased.

Exemplary Embodiment 2

Figure 14:
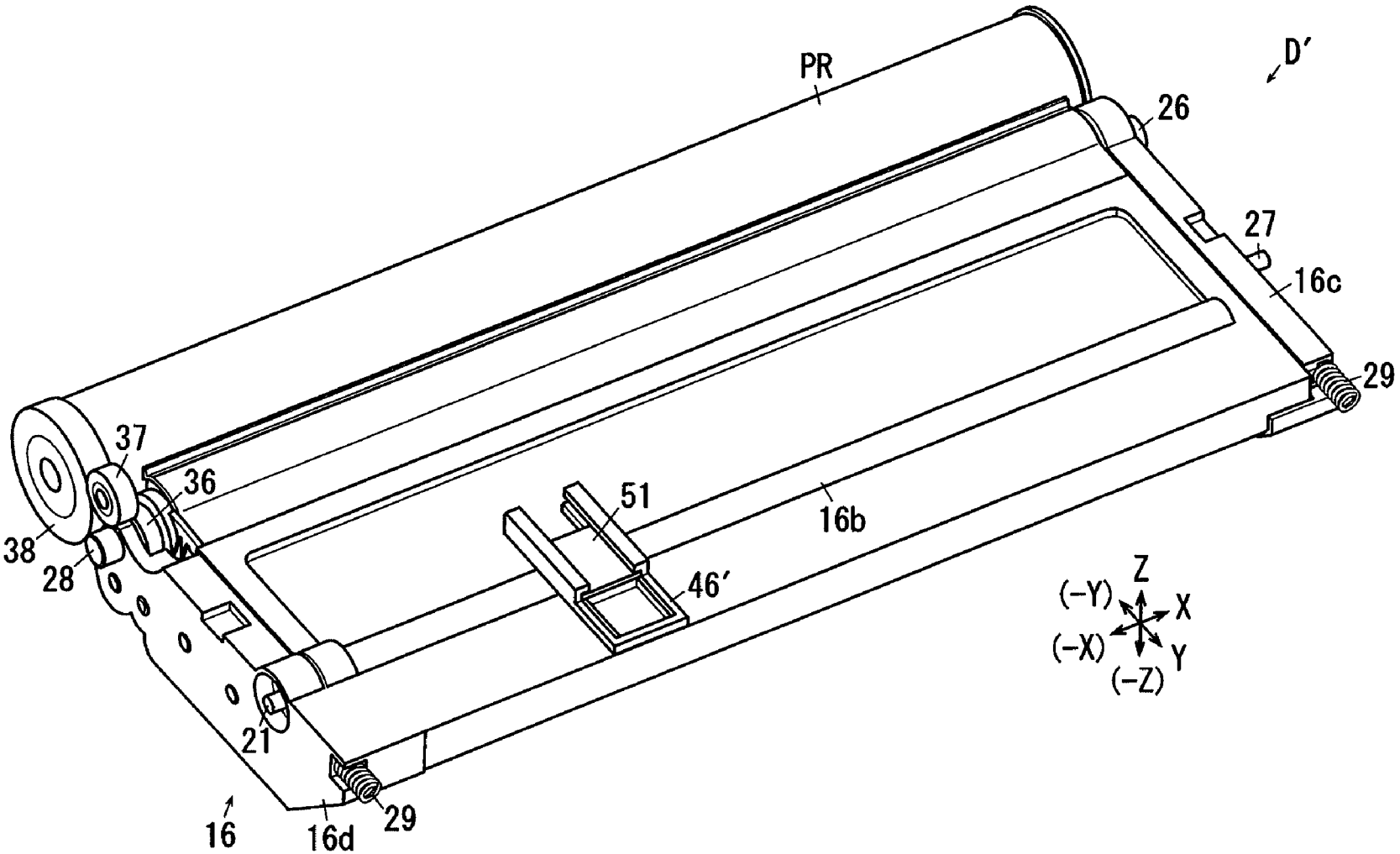
FIG. 14 is a perspective view of a part of a developing device according to the second exemplary embodiment.
Figure 15:
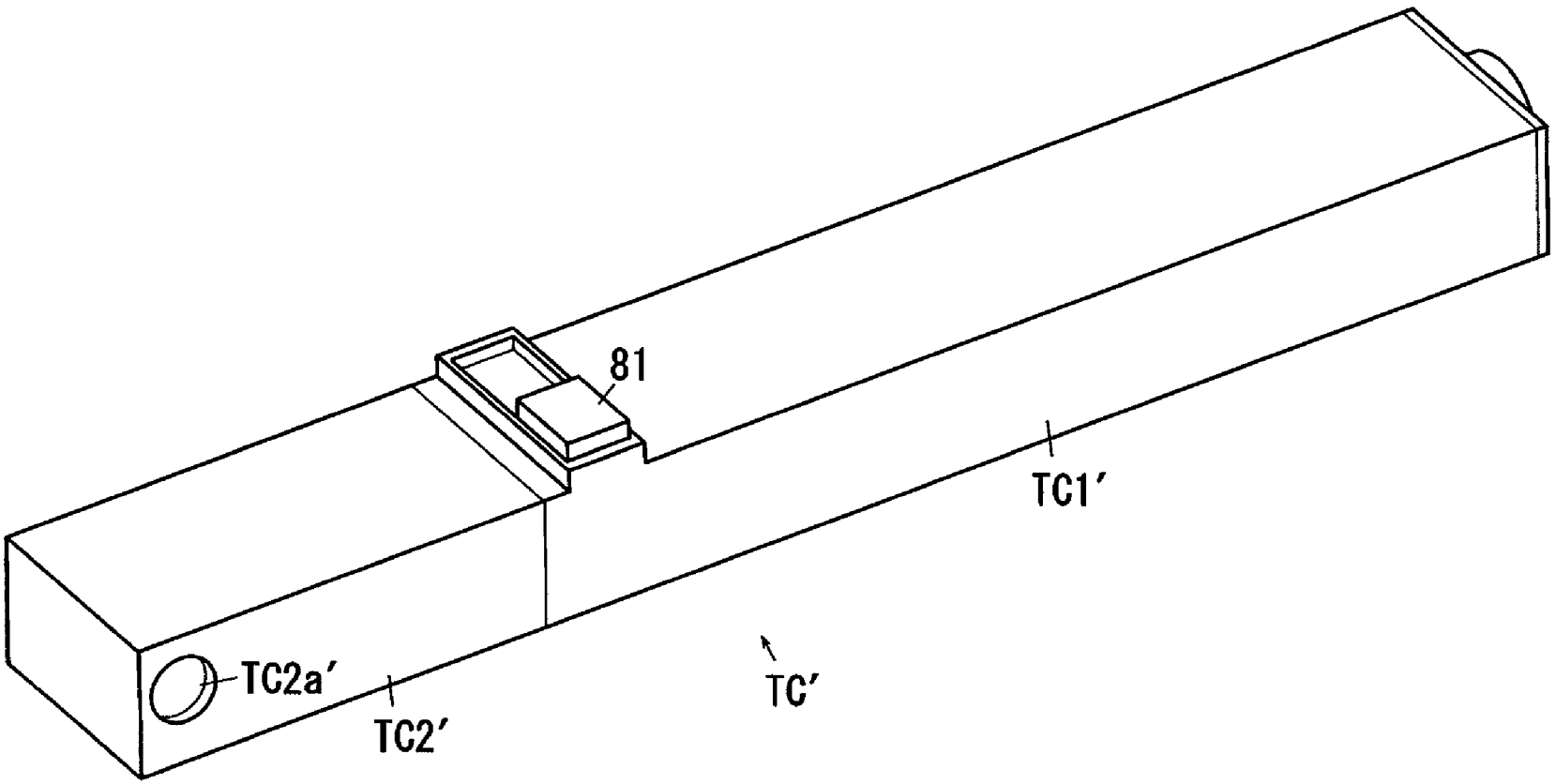
FIG. 15 is a perspective view of the toner cartridge according to the second exemplary embodiment.
Figure 16A:
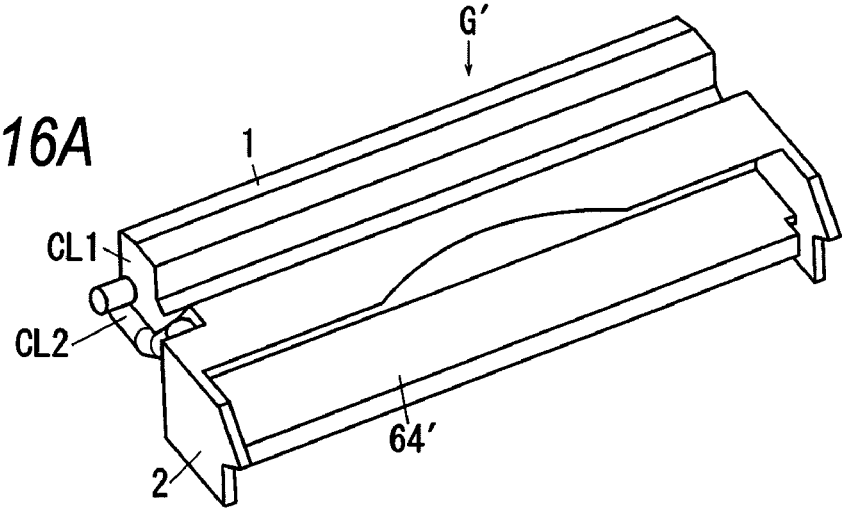
FIGS. 16A, 16B and 16C illustrate a state that the toner cartridge according to the second exemplary embodiment is removed, a state that an attachment/detachment case is moved to a detaching position, and a state before insertion of the toner cartridge into the attachment/detachment case which is in the state of FIG. 16B, respectively.
Figure 16B:
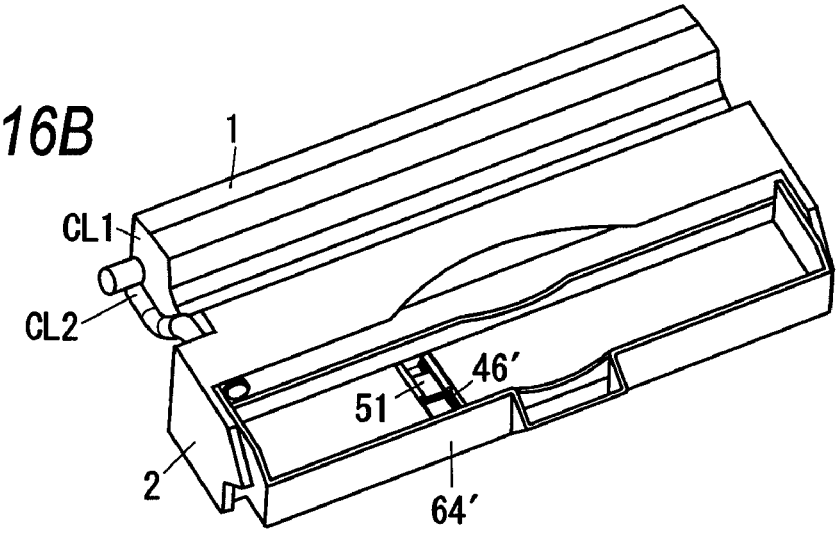
Figure 16C:
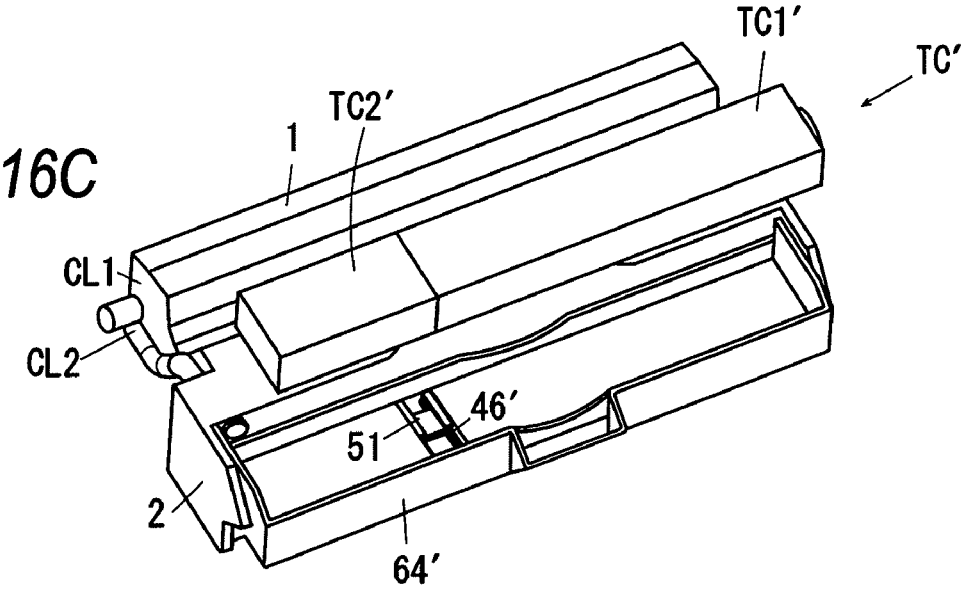
Figure 17A:
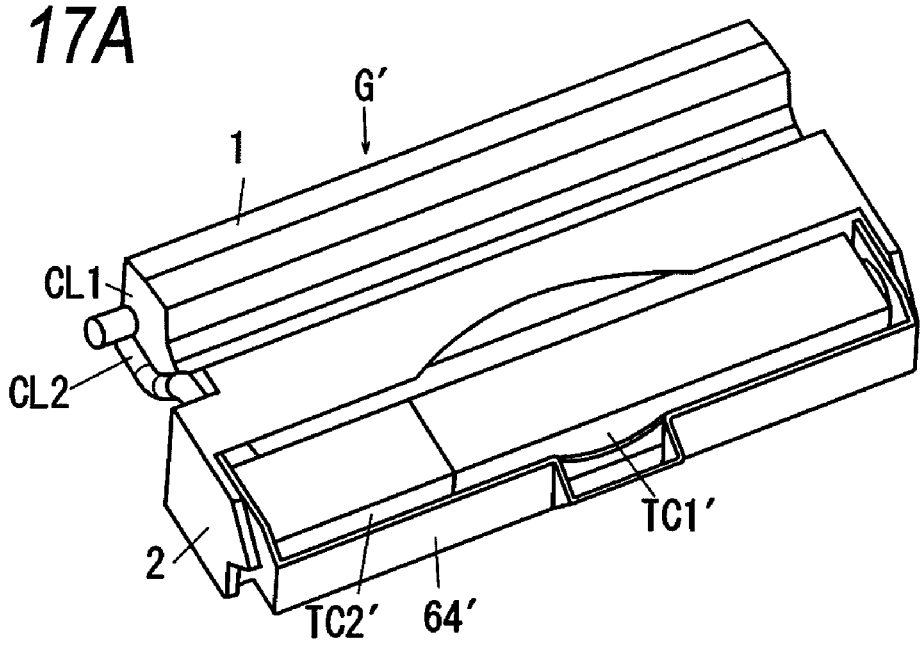
FIGS. 17A and 17B illustrate a state that the toner cartridge is inserted and a state that the attachment/detachment case is moved to a mounting position from the position of FIG. 17A, respectively.
Figure 17B:
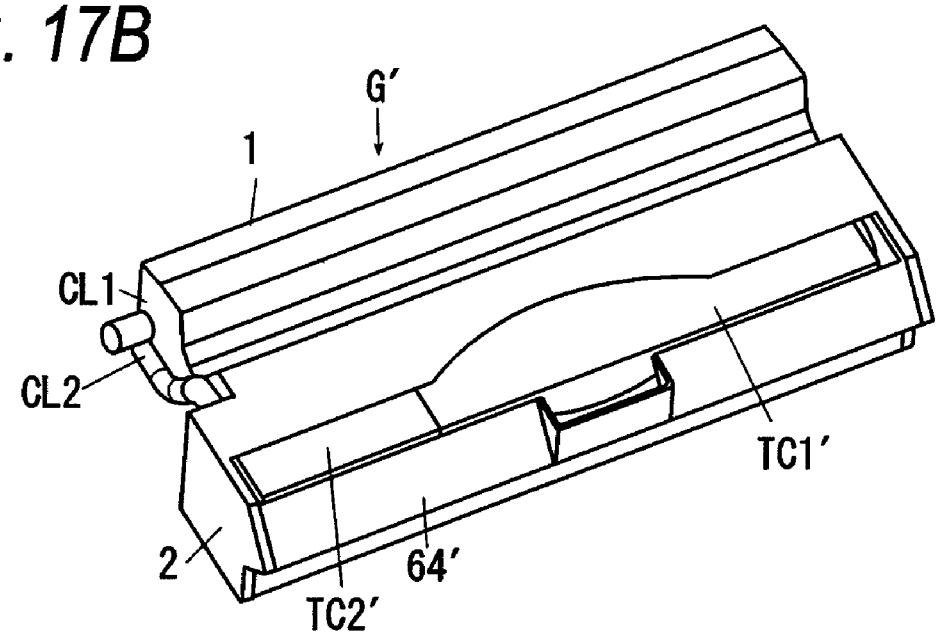

FIGS. 13A and 13B illustrate a toner image forming device according to a second exemplary embodiment in a state that a toner cartridge is moved to a mounting position and in a state the toner cartridge is moved to a detaching position, respectively. FIG. 14 is a perspective view of a part of a developing device according to the second exemplary embodiment. FIG. 15 is a perspective view of the toner cartridge according to the second exemplary embodiment. FIGS. 16A-16C illustrate a state that the toner cartridge according to the second exemplary embodiment is removed, a state that an attachment/detachment case is moved to a detaching position, and a state before insertion of the toner cartridge into the attachment/detachment case which is in the state of FIG. 16B, respectively. FIGS. 17A and 17B illustrate a state that the toner cartridge is inserted and a state that the attachment/detachment case is moved to a mounting position from the position of FIG. 17A, respectively.

In the following description of the second exemplary embodiment of the invention, constituent elements having corresponding ones in the first exemplary embodiment will be given the same reference symbols as the latter and will not be described in detail. The second exemplary embodiment is the same as the first exemplary embodiment except the points described below. In FIGS. 13A and 13B to FIGS. 17A and 17B, the constituent elements having the corresponding ones in the first exemplary embodiment are drawn in a simplified manner.

As shown in FIGS. 13A and 13B, in the toner image forming apparatus G' according to the second exemplary embodiment, the attachment/detachment case 64' (example attachment/detachment manipulation portion) is supported by the second front frame 8 and the second rear frame 9 so as to be rotatable on a rotary shaft which extends in the front-rear direction. The attachment/detachment case 64' is supported so as to be movable between a mounting position (see FIG. 13A) where it closes the Cartridge holding room 13 and a detaching position (see FIG. 13B) where it opens the cartridge holding room 13 to the outside.

As shown in FIG. 14, in the developing device D' according to the second exemplary embodiment, a shutter guide 46' (example hole connection member) extends in the right-left direction in contrast to the shutter guide 46 of the first exemplary embodiment which extends in the front-rear direction. The shutter guide 46' of the second exemplary embodiment has gaps 49 which allow the shutter guide 46' to move in the front-rear direction and the right-left direction relative to the lid member 16*b* of the developing device D'.

As shown in FIG. 15, in the toner cartridge TC' according to the second exemplary embodiment, a supply developer containing portion TC1' which contains a new developer is provided on the front side and a collected developer containing portion TC2' which contains developer that has been collected by the cleaner CL1 is provided on the read side. The outlet shutter 81 is supported by the bottom surface of the supply developer containing portion TC1' so as to be movable in the right-left direction. The right side surface of the collected developer containing portion TC2' is formed with a collection hole TC2*a'*.

As shown in FIGS. 13B, FIGS. 16A-16C, and FIGS. 17A and 17B, in the toner image forming device G' according to the second exemplary embodiment, a collection transport passage CL2 which extends to inside the cartridge holding room 13 past a space behind the toner image forming device G' is connected to a rear portion of the cleaner CL1. The end portion, located inside the cartridge holding room 13, of the collection transport passage CL2 is shaped so that it can be inserted into the collection hole TC2*a'*. A transport member (not shown) is provided inside the collection transport passage CL2 and transports developer from the cleaner CL1 to the collected developer containing portion TC2'.

To mount the toner cartridge TC' according to the second exemplary embodiment, the attachment/detachment case 64' is moved from the state of FIG. 16A to the state of FIG. 16B (detaching position). Then, as shown in FIGS. 16C and 17A, the toner cartridge TC' is put into the attachment/detachment case 64'. Then, as shown in FIGS. 17B and 13A, the attachment/detachment case 64' is moved to the mounting position. At this time, the shutters 51 and 81 are moved to the opening positions and the collection passage CL2 is connected to the collection hole TC2*a'*. As a result, developer can be supplied from the supply developer containing portion TC1' to the developing device D' and developer can be collected from the cleaner CL1 to the collected developer containing portion TC2'.

The toner cartridge TC' can be removed by moving the attachment/detachment case 64' to the detaching position (see FIG. 13B).

(Workings of Exemplary Embodiment 2)

Like the toner image forming device G according to the first exemplary embodiment, the toner image forming device G' according to the second exemplary embodiment can lower the probability of occurrence of a tracking failure.

(Modifications)

The exemplary embodiments of the invention have been described above in detail. However, the invention is not limited to those exemplary embodiments and various modifications are possible without departing from the scope of the invention which is described in the claims. Example modifications (H01) to (H08) to the exemplary embodiments are as follows:

(H01) Although each of the above exemplary embodiments is directed to the copier which is an example image forming apparatus, the invention is not limited to such a case. The invention can also be applied to a printer and a facsimile machine, a multifunction apparatus having the functions of a copier, a printer, a facsimile machine, etc., and other apparatus.

(H02) Although in each of the above exemplary embodiments the copier U uses a developer of a single color, the invention is not limited to such a case. The invention can also be applied to an image forming apparatus of multiple (two or more) colors. That is, the invention can also be applied to an image forming apparatus that is equipped with plural sets of the photoreceptor body PR, the developer D or D', and the toner cartridge TC or TC'.

(H03) Although in each of the above exemplary embodiments the toner image forming device G or G' is such that the cleaner CL1, the charging roll CR, the charging roll cleaner CLC, the charge remover JD, etc. are integrated together, the invention is not limited to such a case. A configuration is possible in which not all of those components are integrated together. For example, only the developer D or D' and the cartridge holder 2 may be unitized.

(H04) Although in each of the above exemplary embodiments the bottom seal 44 allows movement of the shutter guide 46 or 46', the invention is not limited to such a case. The shutter guide 46 or 46' may be made movable by rails or the like.

(H05) In each of the above exemplary embodiments, the seals 44, 48, and 82 may be used. However, it is possible to omit all or part of those seals 44, 48, and 82.

(H06) Although in each of the above exemplary embodiments the inlet shutter 51 is supported by the shutter guide 46 or 46' (example hole connection member), the invention is not limited to such a case. A structure is possible in which the inlet shutter 51 is supported by the developing device container 16 and a hole connection member which connects a developer inlet and outlet and is movable in the direction in which it comes close to and goes away from the photoreceptor body PR is provided outside the inlet shutter 51.

(H07) The mechanisms for opening and closing the inlet shutter 51 and the outlet shutter 81 are not limited to the ones disclosed in each of the exemplary embodiments, and known arbitrary mechanisms may be employed instead.

(H08) Although in each of the above exemplary embodiments the developing device D or D' is supported via the development support frames 6+7+8+9 which are supported by the photoreceptor body holder 1, so as to be movable relative to the photo receptor body PR, the invention is not limited to such a case. A configuration is possible in which the photoreceptor body holder and the support frame are integrated together and the developing device D or D' is supported directly by the photoreceptor body holder in a movable manner. Although in each of the above exemplary embodiments the toner image forming device G or G' and the developing device D or D' are units that can be attached to and detached from the copier main body U1, the invention is not limited to such a case. A configuration is possible in which those units cannot be attached to or detached from the image forming device main body. That is, the developing device D or D' may be supported by the image forming device main body.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A visible image forming device comprising:

an image carrier;

a developing device that is provided to be movable in a direction in which the developing device comes close to and goes away from the image carrier, and that serves to develop a latent image formed on a surface of the image carrier into a visible image, wherein the developing device comprises:

a developing device container that transports developer inside the developing device container;

a developer carrier that is opposed to the image carrier, and holds developer supplied from the developing device container on a surface of the developer carrier; and an inlet through which developer flows into the developing device container;

an urging member that urges the developing device in such a direction that the developing device comes closes to the image carrier;

a contact subject portion that is integral with the image carrier;

a contact portion that is provided in the developing device, and that contacts the contact subject portion, wherein an interval is kept between the image carrier and the developer carrier at a preset value; and wherein the inlet is connected to an outlet through which developer flows out of a container main body so as to be movable relative to the outlet in the movable direction of the developing device.

2. An image forming apparatus comprising:

an image carrier;

a developing device that is provided to be movable in a direction in which the developing device comes close to and goes away from the image carrier, and that serves to develop a latent image formed on a surface of the image carrier into a visible image, wherein the developing device comprises:

a developing device container that transports developer inside the developing device container;

a developer carrier that is opposed to the image carrier, and holds developer supplied from the developing device container on a surface of the developer carrier; and an inlet through which developer flows into the developing device container;

an urging member that urges the developing device in such a direction that the developing device comes closer to the image carrier;

a contact subject portion that is integral with the image carrier;

a contact portion that is provided in the developing device, and that contacts the contact subject portion, wherein an interval is kept between the image carrier and the developer carrier at a preset value; and a developer container that is detachably mounted in a mounting unit which is integral with a support frame which supports the image carrier, wherein the developer container comprises:

a container main body that contains developer to be supplied to the developing device container; and an outlet, opposed to the inlet, through which developer flows out from inside the container main body, wherein the inlet is connected to the outlet so as to be movable relative to the outlet in the movable direction of the developing device.

3. The image forming apparatus according to claim 2, further comprising:

a hole connection member that is supported so as to be movable relative to the inlet in the movable direction of the developing device and that connects the inlet and the outlet; and an inlet opening/closing member that is supported by the hole connection member so as to be movable between an opening position where the inlet opening/closing member opens the inlet and a closing position where the inlet opening/closing member closes the inlet.

4. The image forming apparatus according to claim 2, further comprising:

a first sealing member that is provided between a hole connection member and the inlet, and that seals a space between the hole connection member and the inlet; and a second sealing member that is provided between the hole connection member and the outlet, and that seals a space between the hole connection member and the outlet.

* * * * *